US010060001B2

(12) United States Patent
Heck et al.

(10) Patent No.: US 10,060,001 B2
(45) Date of Patent: Aug. 28, 2018

(54) TOOLING SYSTEM FOR PROCESSING WORKPIECES

(71) Applicant: The Boeing Company, Chicago, IL (US)

(72) Inventors: David P. Heck, St. Charles, MO (US); James B. Castle, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 182 days.

(21) Appl. No.: 14/630,245

(22) Filed: Feb. 24, 2015

(65) Prior Publication Data

US 2015/0167110 A1 Jun. 18, 2015

Related U.S. Application Data

(63) Continuation-in-part of application No. 12/843,420, filed on Jul. 26, 2010, now Pat. No. 8,966,763.

(51) Int. Cl.

| | |
|---|---|
| ***C21D 9/00*** | (2006.01) |
| ***C21D 1/18*** | (2006.01) |
| ***C21D 8/02*** | (2006.01) |
| ***B25B 1/24*** | (2006.01) |
| ***B25B 11/00*** | (2006.01) |

(52) U.S. Cl.

CPC ..... *C21D 9/0068* (2013.01); *B25B 1/2415* (2013.01); *B25B 11/00* (2013.01); *C21D 1/18* (2013.01); *C21D 8/0294* (2013.01)

(58) Field of Classification Search

CPC ..... B22D 7/04; B22D 30/00; B23Q 1/035
See application file for complete search history.

(56) References Cited

U.S. PATENT DOCUMENTS

| | | | | |
|---|---|---|---|---|
| 2,792,211 | A * | 5/1957 | Kennedy | C21D 9/0062 266/121 |
| 2,890,975 | A * | 6/1959 | Lenz | C21D 1/62 148/644 |
| 3,559,447 | A | 2/1971 | Bogart | |
| 3,944,446 | A * | 3/1976 | Bober | C21D 1/10 148/572 |
| 5,546,784 | A | 8/1996 | Haas et al. | |
| 5,954,175 | A | 9/1999 | Haas et al. | |
| 6,074,599 | A | 6/2000 | Murty et al. | |
| 6,089,061 | A | 7/2000 | Haas et al. | |
| 6,209,380 | B1 | 4/2001 | Papazian et al. | |

(Continued)

FOREIGN PATENT DOCUMENTS

| | | | |
|---|---|---|---|
| EP | 1531185 B1 | 3/2010 | |
| WO | WO 2011048365 A1 * | 4/2011 | B29C 35/0288 |

OTHER PUBLICATIONS

Heck et al., "Tooling System for Processing Workpieces," U.S. Appl. No. 12/843,420, filed Jul. 26, 2010, 51 pages.

*Primary Examiner* — Jacob Cigna
(74) *Attorney, Agent, or Firm* — Yee & Associates, P.C.

(57) ABSTRACT

Methods for processing workpieces. A first temperature of a first section of a workpiece having a non-uniform thickness may be maintained. A cooling rate of a second section of the workpiece may be controlled while maintaining the first temperature of the first section. The workpiece may be quenched after cooling the second section of the workpiece to form a quenched workpiece, in which the cooling rate may be controlled such that the second section of the workpiece has desired properties.

20 Claims, 22 Drawing Sheets

(56) References Cited

U.S. PATENT DOCUMENTS

| | | | | |
|---|---|---|---|---|
| 6,394,793 | B1 | 5/2002 | Bunge | |
| 6,415,191 | B1 | 7/2002 | Pryor | |
| 6,578,399 | B1 | 6/2003 | Haas et al. | |
| 6,644,637 | B1 | 11/2003 | Shen et al. | |
| 6,793,140 | B2 | 9/2004 | Mazumder | |
| 6,925,346 | B1 | 8/2005 | Mazumder et al. | |
| 6,993,948 | B2 | 2/2006 | Offer | |
| 7,055,679 | B2 | 6/2006 | Shen et al. | |
| 7,073,561 | B1 | 7/2006 | Henn | |
| 7,286,893 | B1 | 10/2007 | Mazumder | |
| 7,610,790 | B2 | 11/2009 | Halford | |
| 7,703,190 | B2 | 4/2010 | Halford | |
| 9,034,234 | B2 * | 5/2015 | Halford | B29C 35/0288 264/327 |
| 2005/0012250 | A1 * | 1/2005 | Rabinovich | C21D 1/56 266/46 |
| 2005/0109590 | A1 | 5/2005 | Shen et al. | |
| 2008/0016938 | A1 | 1/2008 | Halford | |
| 2008/0122152 | A1 | 5/2008 | Halford | |
| 2008/0203640 | A1 | 8/2008 | Halford | |
| 2009/0020936 | A1 | 1/2009 | Halford | |
| 2009/0056517 | A1 | 3/2009 | Halford | |
| 2009/0250857 | A1 | 10/2009 | Halford | |
| 2010/0295229 | A1 | 11/2010 | Halford | |
| 2012/0135197 | A1 | 5/2012 | Halford | |
| 2012/0267828 | A1 * | 10/2012 | Halford | B29C 35/0288 264/327 |
| 2012/0280415 | A1 | 11/2012 | Halford | |

* cited by examiner

TOOLING SYSTEM FOR PROCESSING WORKPIECES

CROSS-REFERENCE TO RELATED APPLICATIONS

This application is a Continuation-in-Part application of U.S. patent application Ser. No. 12/843,420, filed Jul. 26, 2010, entitled "Tooling System for Processing Workpieces," which is incorporated herein by reference.

BACKGROUND INFORMATION

1. Field

The present disclosure relates generally to manufacturing and, in particular, to a method and apparatus for processing workpieces. Still more particularly, the present disclosure relates to a method and apparatus for controlling the properties of metal workpieces.

2. Background

Metal parts may be heated to high temperatures to achieve desired material properties. It may be desirable to quickly reduce the temperature of the metal to obtain certain material properties. The metal parts may then be quenched to rapidly cool the metal and lock in the material properties. Quenching may include subjecting the hot parts to a liquid or gas. For example, dropping the hot parts into a container of liquid may be a form of quenching. Placing the hot parts in the path of a moving gas, such as an airstream, may also be a form of quenching.

Differences in part geometry may cause uneven cooling rates during quenching. Uneven cooling rates may result in at least one of warpage or residual stresses. The warpage or residual stresses may result in unacceptable geometric variations. Further, uneven cooling rates may result in a difference in mechanical properties between different areas of the part.

When warpage occurs, the part being formed may need to be reworked and/or scrapped. Further, parts with undesirable amounts of stresses may need to be scrapped. These situations may increase the time and/or cost needed to manufacture parts. As a result, assembly and manufacturing of products may need more time and may incur more costs than desired.

It would be advantageous to have a method and apparatus that takes into account one or more of the issues discussed above, as well as other possible issues. For example, it may be desirable to have a method and apparatus to reduce residual stresses in quenched metal workpieces. Further, it may be desirable to have a method and apparatus to obtain substantially consistent material properties throughout a quenched metal workpiece.

SUMMARY

An illustrative embodiment of the present disclosure may provide a method. A first temperature of a first section of a workpiece having a non-uniform thickness may be maintained. A cooling rate of a second section of the workpiece may be controlled while maintaining the first temperature of the first section. The workpiece may be quenched after cooling the second section of the workpiece to form a quenched workpiece, in which the cooling rate is controlled such that the second section of the workpiece has desired properties.

Another illustrative embodiment of the present disclosure may provide a method. A workpiece having non-uniform thickness may be placed between a first platform and a second platform. A cooling rate of a first section of the workpiece may be controlled such that the first section of the workpiece is cooler than a remainder of the workpiece to form a treated workpiece. The treated workpiece may be quenched to form a quenched workpiece, in which the cooling rate may be controlled such that a second section of the workpiece has desired properties.

A further illustrative embodiment of the present disclosure may provide a method. A workpiece may be placed between a first platform and a second platform. First fingers may be extended from the first platform to engage a first surface of the workpiece. Second fingers may be extended from the second platform to engage a second surface of the workpiece. A cooling rate of a first section of the workpiece may be controlled, in which controlling the cooling rate may comprise applying a first temperature to a first portion of the first surface of the workpiece using a first number of the first fingers. Controlling the cooling rate may further comprise applying the first temperature to a third portion of the second surface of the workpiece using a third number of the second fingers. A temperature of a second section of the workpiece may be maintained, in which maintaining the temperature may comprise applying a second temperature to a second portion of the first surface of the workpiece using a second number of the first fingers. Maintaining the temperature may further comprise applying the second temperature to a fourth portion of the second surface of the workpiece using a fourth number of the second fingers. The workpiece may be quenched after cooling the first section of the workpiece to form a quenched workpiece, in which the cooling rate may be controlled such that the first section of the workpiece has desired properties.

The features, functions, and advantages may be achieved independently in various embodiments of the present disclosure or may be combined in yet other embodiments in which further details may be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives, and advantages thereof, will best be understood by reference to the following detailed description of an illustrative embodiment of the present disclosure when read in conjunction with the accompanying drawings, wherein:

DETAILED DESCRIPTION

Some illustrative examples relate generally to manufacturing and, in particular, to a method and apparatus for processing workpieces. Still more particularly, some illustrative examples relate to a method and apparatus for depositing materials on a workpiece.

In manufacturing aircraft, different structures may be assembled to form the aircraft. These structures may be assembled from different parts. For example, without limitation, I-beams, skin panels, and other parts may be connected to each other to form a fuselage and/or wings of an aircraft.

The different structures may be comprised of materials, such as, for example, without limitation, metals, metal alloys, composite materials, and other suitable types of materials. With metals, titanium may be used in different parts. In forming a titanium part, titanium may be deposited onto a substrate to form the part. The substrate may be a titanium plate.

The deposition of metal onto metal plates may be performed using a number of different types of techniques. For example, without limitation, metal may be deposited onto a metal plate using an electron beam deposition system. A metal wire from a feeder may be changed into a molten state with the molten metal being deposited onto the plate.

This type of processing may be performed in near-room temperature environments. The differences in temperature between the molten metal and the plate may lead to stresses in the metal plate. These stresses may result in distortion and peeling of the metal deposited onto the metal plate.

When these distortions occur, the part being formed may need to be reworked and/or scrapped. These situations may increase the time and/or cost needed to manufacture parts. As a result, the assembly and manufacturing of aircraft may need more time and may incur more costs than desired.

Figure 1:
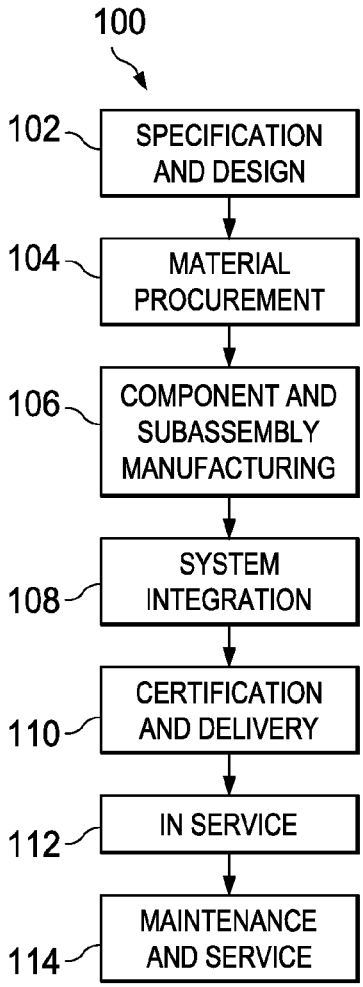
FIG. 1 is an illustration of a block diagram of an aircraft manufacturing and service method in accordance with an illustrative embodiment.
Figure 2:
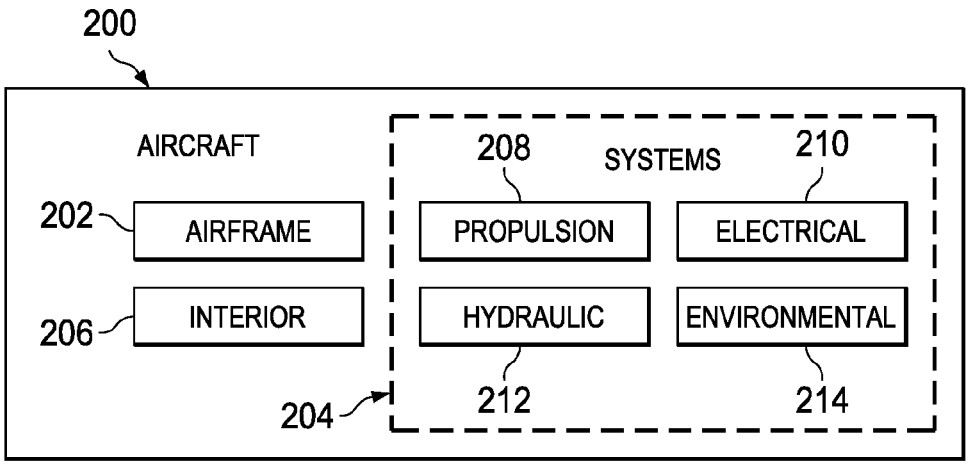
FIG. 2 is an illustration of a block diagram of an aircraft in which an illustrative embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of a block diagram of an aircraft manufacturing and service method is depicted in accordance with an illustrative embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG. 2 may take place. Thereafter, aircraft 200 in FIG. 2 may go through certification and delivery 110 in order to be placed in service 112. While in service 112 by a customer, aircraft 200 in FIG. 2 may be scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, an illustration of a block diagram of an aircraft is depicted in which an illustrative embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different illustrative embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A, or item A and item B. This example also may include item A, item B, and item C, or item B and item C.

In one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1. A number, when referring to items, means one or more items. For example, a number of apparatus embodiments is one or more apparatus embodiments. A number of apparatus embodiments, method embodiments, or a combination thereof may be utilized while aircraft 200 is in service 112 and/or during maintenance and service 114 in FIG. 1. The use of a number of the different illustrative embodiments may substantially expedite the assembly of and/or reduce the cost of aircraft 200.

The different illustrative embodiments recognize and take into account a number of different considerations. For example, without limitation, the different illustrative embodiments recognize and take into account that distortions in the material deposited on a substrate may be caused by thermal stresses in the substrate. When the material and the substrate take the form of metal, one solution may involve using thicker metal plates. The increased thickness of the metal plate may reduce distortion.

The different illustrative embodiments also recognize and take into account that by using thicker metal plates, the part may be more expensive than desired. Further, the different illustrative embodiments recognize and take into account that a thicker metal plate also may result in a part that may be heavier than desired.

The different illustrative embodiments recognize and take into account that another solution may involve reducing the thermal stress in the metal plate. For example, without limitation, after depositing metal onto the metal plate, the metal plate may be moved from the deposition area to an oven. The oven may heat the metal plate to reduce stress in the metal plate. Thereafter, the metal plate with the material may be returned to the deposition area for additional deposition of materials. This type of process may be performed repeatedly until the part is completed.

The different illustrative embodiments recognize and take into account that this type of solution may take larger amounts of time than desired. Some parts may require one to two days to reduce the thermal stress in a metal plate each time a thermal stress reduction process is performed. This amount of time may increase the time needed to manufacture parts beyond what may be desired.

The different illustrative embodiments recognize and take into account that another solution may involve heating the metal plate on which the metal is deposited. The heating of the metal plate may be performed by placing the metal plate on a heated planar surface that heats the metal plate. The increase in temperature in the metal plate may reduce thermal stresses in the metal plate. As a result, decreases in distortions in the metal deposited on the metal plate may occur.

The different illustrative embodiments recognize and take into account, however, that the use of a planar heating surface may not provide the desired heating for the metal plate. For example, without limitation, the different illustrative embodiments recognize and take into account that after depositing metal on a first side of the metal plate, the metal plate may be flipped over. Additional deposition of metal may then be performed on the second side of the metal plate, which is opposite to the first side.

The different illustrative embodiments recognize and take into account that features on the first side of the metal plate may prevent the desired heating of the metal plate when deposition of material is performed for the second side. For example, without limitation, the features may have a height and/or depth that may prevent the planar heating surface from contacting the metal plate. As a result, the features deposited onto the metal plate may be heated.

Thus, the different illustrative embodiments provide a method and apparatus for processing workpieces. A plurality of elements may be positioned to substantially conform to a surface on a first side of a workpiece. Heating may be performed to heat the plurality of elements, while the plurality of elements may be substantially conformed to the surface of the first side of the workpiece. A material may then be deposited on the workpiece, while heating the plurality of elements.

Figure 3:
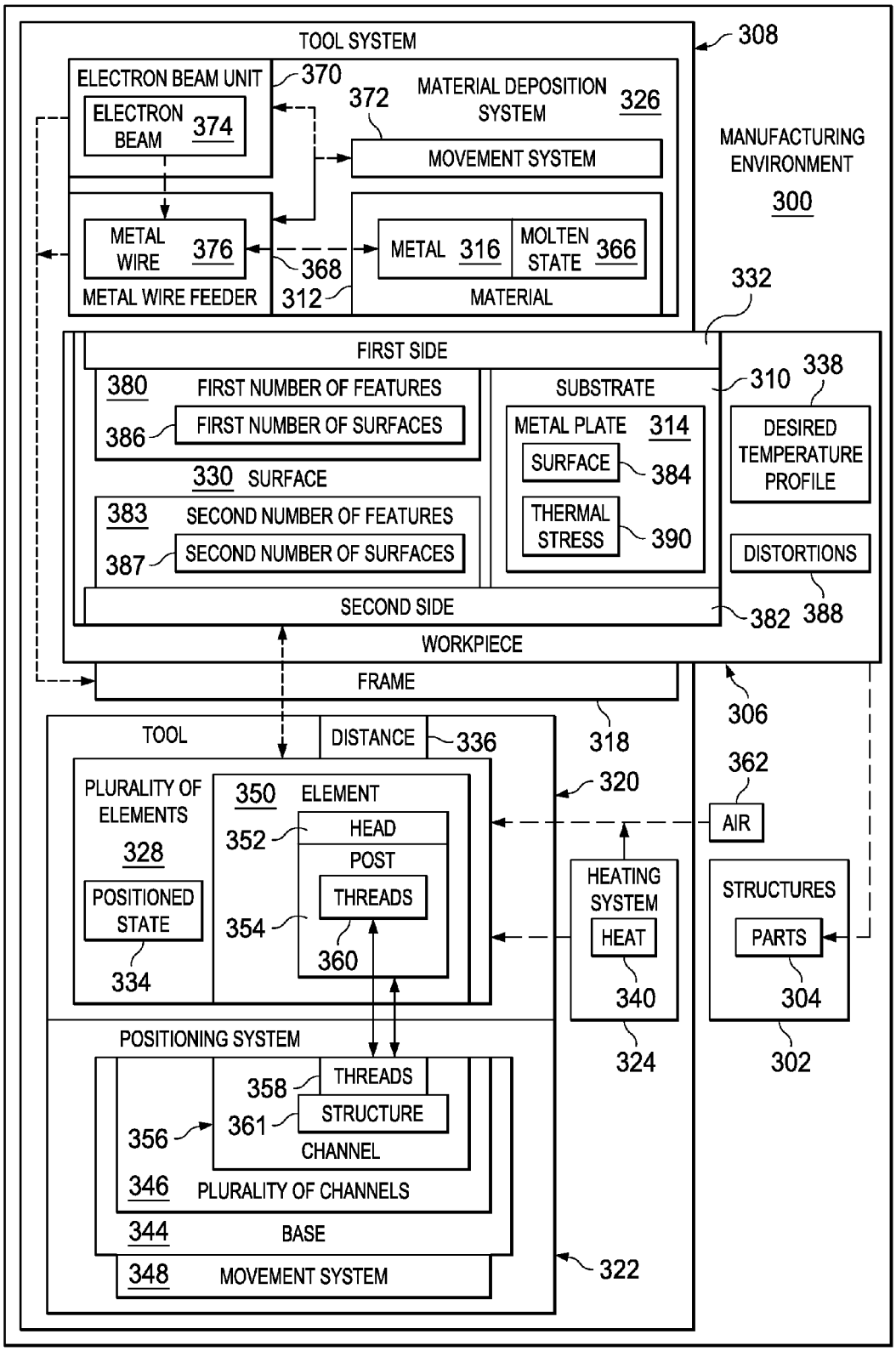
FIG. 3 is an of illustration of a block diagram of a manufacturing environment in accordance with an illustrative embodiment.

With reference now to FIG. 3, an illustration of a block diagram of a manufacturing environment is depicted in accordance with an illustrative embodiment. Manufacturing environment 300 may be used to manufacture structures 302 for aircraft 200 in FIG. 2. In these examples, parts 304 may be assembled to form structures 302.

In the different illustrative examples, workpiece 306 may be processed using tool system 308. In these illustrative examples, workpiece 306 may be an object in the process of being worked on and/or processed to form one or more of parts 304.

Workpiece 306 may take the form of substrate 310. Material 312 may be deposited onto substrate 310 using tool system 308. In these illustrative examples, substrate 310 may take the form of metal plate 314. Metal plate 314 may be comprised of at least one of, for example, without limitation, a metal, a metal alloy, aluminum, titanium, plastic, a composite material, and/or some other combination of materials.

In these illustrative examples, material 312 may take the form of metal 316. Metal 316 may be a pure metal, a metal alloy, titanium, aluminum, steel, a nickel alloy, and/or some other suitable type of metal. In other illustrative embodiments, material 312 may take other forms, such as, for example, without limitation, a resin, a plastic, and/or other suitable materials.

As depicted in this example, tool system 308 may comprise frame 318, tool 320, positioning system 322, heating system 324, material deposition system 326, and/or other suitable components. Frame 318 may provide a structure to hold workpiece 306 in these examples.

Tool 320 may comprise plurality of elements 328. Plurality of elements 328 may be configured to move relative to each other. In other words, elements in plurality of elements 328 may all move together and/or individually with respect to other elements in plurality of elements 328. Additionally, elements in plurality of elements 328 may move the same distance and/or different distances as compared to other elements in plurality of elements 328.

Positioning system 322 may be configured to move plurality of elements 328 to substantially conform to surface 330 of workpiece 306 on first side 332 of workpiece 306. When positioned by positioning system 322, plurality of elements 328 may be in positioned state 334. In these illustrative examples, in positioned state 334, plurality of elements 328 may substantially conform to surface 330 and/or touch surface 330.

In other illustrative examples, plurality of elements 328 may not touch surface 330. Instead, each of plurality of elements 328 may be positioned at distance 336 from surface 330 such that heating of plurality of elements 328 may heat workpiece 306 to desired temperature profile 338. Further, distance 336 may not be the same distance for each of plurality of elements 328.

In this manner, different portions of workpiece 306 may be heated to different temperatures to meet desired temperature profile 338. Desired temperature profile 338 may include a specification of temperatures for different portions of workpiece 306. These temperatures may be individual temperatures, temperature ranges, and/or may include tolerances, depending on the particular implementation. Additionally, desired temperature profile 338 may include a specification of temperatures for different portions of workpiece 306 based on time, locations of the different portions, and/or the particular stage of processing for workpiece 306.

Heating system 324 may generate heat 340 in plurality of elements 328 sufficient to cause workpiece 306 to reach desired temperature profile 338. Material deposition system 326 may deposit material 312 onto workpiece 306.

As illustrated, positioning system 322 may comprise base 344 and movement system 348. Base 344 may have plurality of channels 346. Plurality of channels 346 may be configured to receive plurality of elements 328. Movement system 348 may move plurality of elements 328 within plurality of channels 346.

In these examples, an element, such as element 350 in plurality of elements 328, may comprise head 352 and post 354. Head 352 may be located at an end of post 354. Head 352 may be the portion of element 350 that may be positioned to substantially conform to surface 330 of workpiece 306. Head 352 and post 354 of element 350 may be comprised of materials capable of conducting heat. For example, without limitation, head 352 and post 354 may be comprised of a material selected from at least one of a metal, a metal alloy, ceramic, and/or some other suitable material.

In this illustrative example, post 354 may be received in channel 356 in plurality of channels 346. Channel 356 may have threads 358, and post 354 may have threads 360. Threads 358 in channel 356 may be located in structure 361 within channel 356. Structure 361 may be configured to rotate to cause threads 358 to move relative to threads 360 to cause movement of post 354. In this manner, post 354 may be moved to position head 352 relative to surface 330 in these illustrative examples.

Of course, in other illustrative examples, post 354 may be rotated to move element 350. In still other illustrative embodiments, other mechanisms may be used to move element 350 to position element 350 relative to surface 330 of workpiece 306.

In these illustrative examples, heating system 324 may be connected to plurality of elements 328 to heat plurality of elements 328. As used herein, when a first component is connected to a second component, the first component may be connected to the second component without any additional components. The first component also may be connected to the second component by one or more other components.

For example, without limitation, heating system 324 may be connected to plurality of elements 328 by a heat exchange system that causes air 362 from heating system 324 to heat plurality of elements 328. For example, air 362 may be moved into plurality of elements 328 by heating system 324. Further, heating system 324 may heat air 362 to a desired temperature to heat plurality of elements 328.

In this case, a direct connection between heating system 324 and plurality of elements 328 may not be needed. Instead, a thermal connection may be present instead of a physical connection between heating system 324 and plurality of elements 328.

Heating system 324 may heat, cool, or heat and cool plurality of elements 328, depending on desired temperature profile 338. Further, in other illustrative examples, post 354 may be directly heated by heating system 324 rather than using air 362. In other illustrative examples, heating system 324 may use a liquid or inert gas instead of air 362 to heat plurality of elements 328.

Material deposition system 326 may comprise a number of different systems configured to deposit material 312 onto workpiece 306. In these examples, material deposition system 326 may deposit material 312 onto workpiece 306 in molten state 366.

For example, without limitation, material deposition system 326 may be comprised of metal wire feeder 368, electron beam unit 370, and movement system 372. Movement system 372 may be configured to move metal wire feeder 368 and electron beam unit 370 on frame 318. Electron beam unit 370 may generate electron beam 374 to cause metal wire 376 to reach molten state 366 for deposition onto substrate 310.

In these illustrative examples, as material 312 is deposited onto workpiece 306 on first side 332, first number of features 380 may be formed on surface 330 on first side 332 of workpiece 306. In this illustrative example, surface 330 on first side 332 of workpiece 306 may comprise surface 384 on first side 332 of metal plate 314 and first number of surfaces 386 of first number of features 380. In other words, surface 330 of workpiece 306 may not be a planar surface.

In this manner, plurality of elements 328 may heat both surface 384 of metal plate 314 and first number of surfaces 386 of first number of features 380 to meet desired temperature profile 338. As a result, distortions 388 in workpiece 306 in the form of metal plate 314 may be reduced. The reduction in distortions 388 may occur as a result of a reduction in thermal stress 390 within metal plate 314. In this manner, distortions 388 in material 312 deposited onto workpiece 306 may be reduced.

After forming first number of features 380 on workpiece 306, workpiece 306 may be flipped over to present second side 382 for deposition of material 312. In this position, plurality of elements 328 may be positioned to substantially conform to surface 330 on second side 382 of workpiece 306.

The heating of plurality of elements 328 may occur while material 312 is being deposited onto second side 382 of workpiece 306 to form second number of features 383. Surface 330 on second side 382 of workpiece 306 may comprise surface 384 on second side 382 of metal plate 314 and second number of surfaces 387 of second number of features 383.

The illustration of manufacturing environment 300 in FIG. 3 is not meant to imply physical or architectural limitations to the manner in which different illustrative embodiments may be implemented. Other components in addition to and/or in place of the ones illustrated may be used. Some components may be unnecessary in some illustrative embodiments. Also, the blocks are presented to illustrate some functional components. One or more of these blocks may be combined and/or divided into different blocks when implemented in different illustrative embodiments.

For example, without limitation, in some illustrative embodiments, material deposition system 326 may deposit a powdered metal onto workpiece 306. The powdered metal may then be sintered to form the different features on workpiece 306. In yet other illustrative embodiments, other components also may be present within tool system 308 other than those illustrated. For example, without limitation, a gas environment system also may be included to perform the deposition of material 312. For example, the gas environment system may provide an inert gas that also may be used to heat or cool workpiece 306 and/or material 312.

Figure 4:
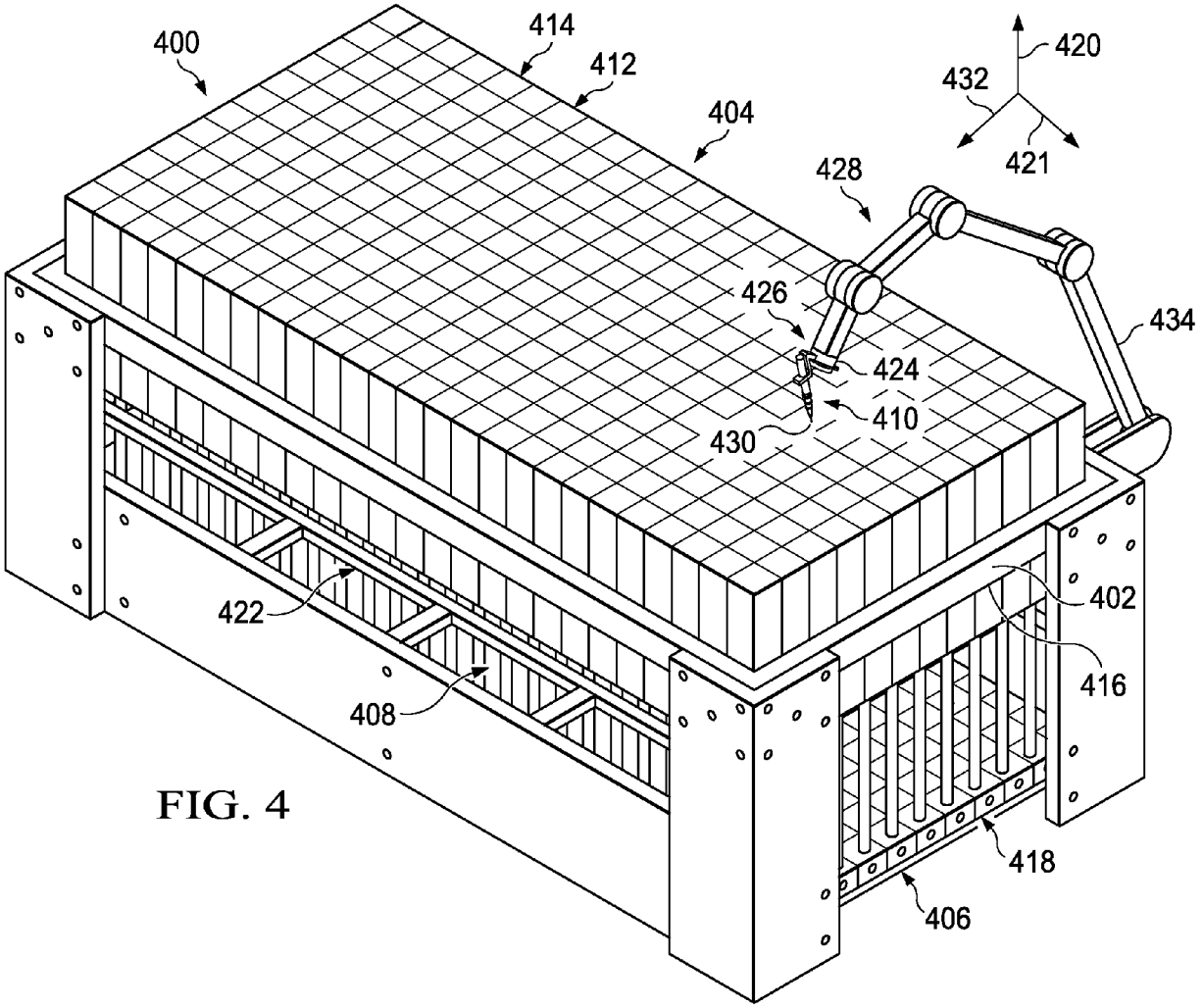
FIG. 4 is an illustration of a perspective view of a tool system in accordance with an illustrative embodiment.

With reference now to FIG. 4, an illustration of a perspective view of a tool system is depicted in accordance with an illustrative embodiment. In this illustrative example, tool system 400 may be an example of one implementation for tool system 308 in FIG. 3. Tool system 400 may include frame 402, tool 404, positioning system 406, heating system 408, and material deposition system 410.

Frame 402 may be configured to hold a workpiece, such as workpiece 306 in FIG. 3. As depicted in this example, tool 404 may comprise plurality of elements 412. Plurality of elements 412 may take the form of plurality of pins 414 in this illustrative example. Each of plurality of pins 414 may have a head with a square shape in this depicted example.

Positioning system 406 may include base 416 and movement system 418. Base 416 may include a plurality of channels (not shown in this view) configured to receive plurality of pins 414. Movement system 418 may be configured to move plurality of pins 414 vertically along axis 420. Plurality of pins 414 may be moved relative to each other. For example, without limitation, movement system 418 may move pins in plurality of pins 414 to the same height or different heights with respect to base 416.

In this illustrative example, heating system 408 may include heat exchange system 422. Heat exchange system 422 may be configured to heat plurality of pins 414 to meet a temperature profile for plurality of pins 414. For example, without limitation, different portions of plurality of pins 414 may be heated to different temperatures. The heating of plurality of pins 414 may allow a workpiece placed on plurality of pins 414 to also be heated to meet a desired temperature profile for the workpiece.

Material deposition system 410 may include metal wire feeder 424, electron beam unit 426, and movement system 428. Metal wire feeder 424 may feed metal wire 430. Electron beam unit 426 may generate an electron beam that may come into contact with metal wire 430. The electron beam may cause metal wire 430 to melt, such that a molten state of the material in metal wire 430 may be deposited on the surface of a workpiece placed on tool 404.

In this illustrative example, movement system 428 may move electron beam unit 426 and metal wire feeder 424 in the directions of axis 420, axis 421, and axis 432. In this manner, material deposition system 410 may be moved over frame 402 for tool system 400 to deposit the material formed from melting metal wire 430 at different locations.

Additionally, movement system 428 may include arm 434. Arm 434 may connect material deposition system 410 to frame 402 for tool system 400.

Figure 5:
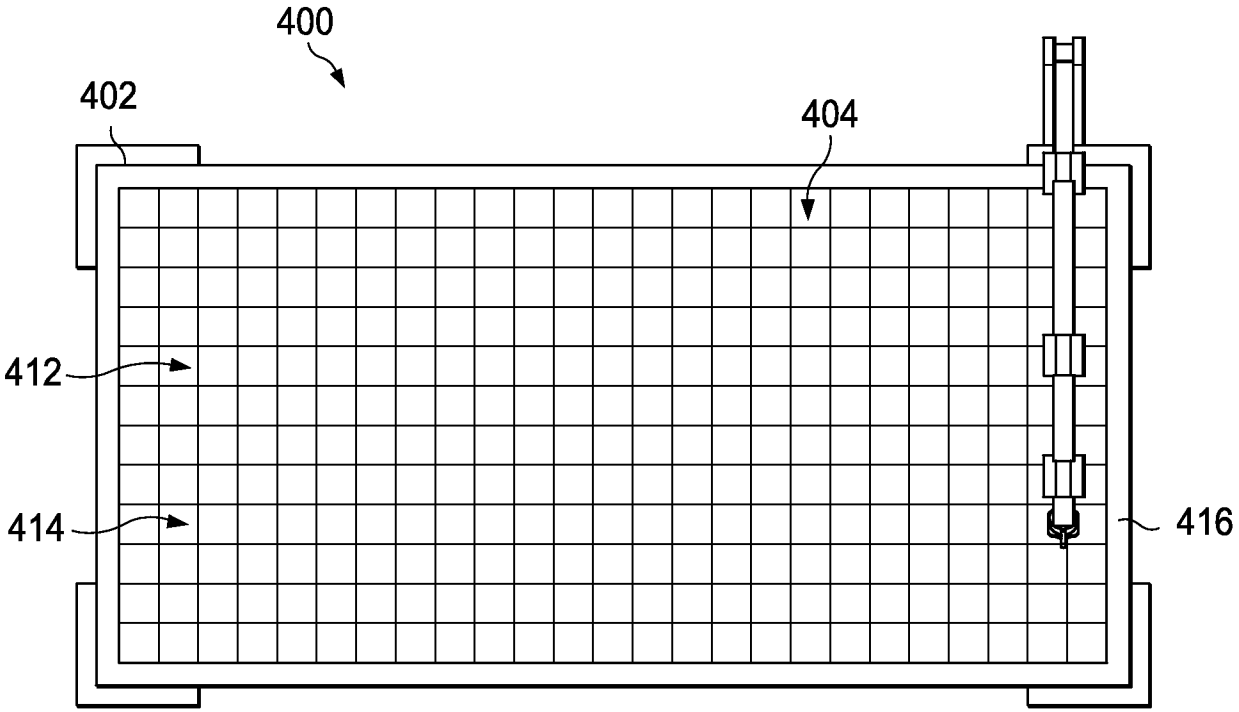
FIG. 5 is an illustration of a top view of a frame and tool for a tool system in accordance with an illustrative embodiment.

With reference now to FIG. 5, an illustration of a top view of a frame and tool for a tool system is depicted in accordance with an illustrative embodiment. In this illustrative example, frame 402 and tool 404 for tool system 400 in FIG. 4 are depicted. Each of plurality of elements 412 may have the same height relative to axis 420 in FIG. 4 in this depicted example.

Figure 6:
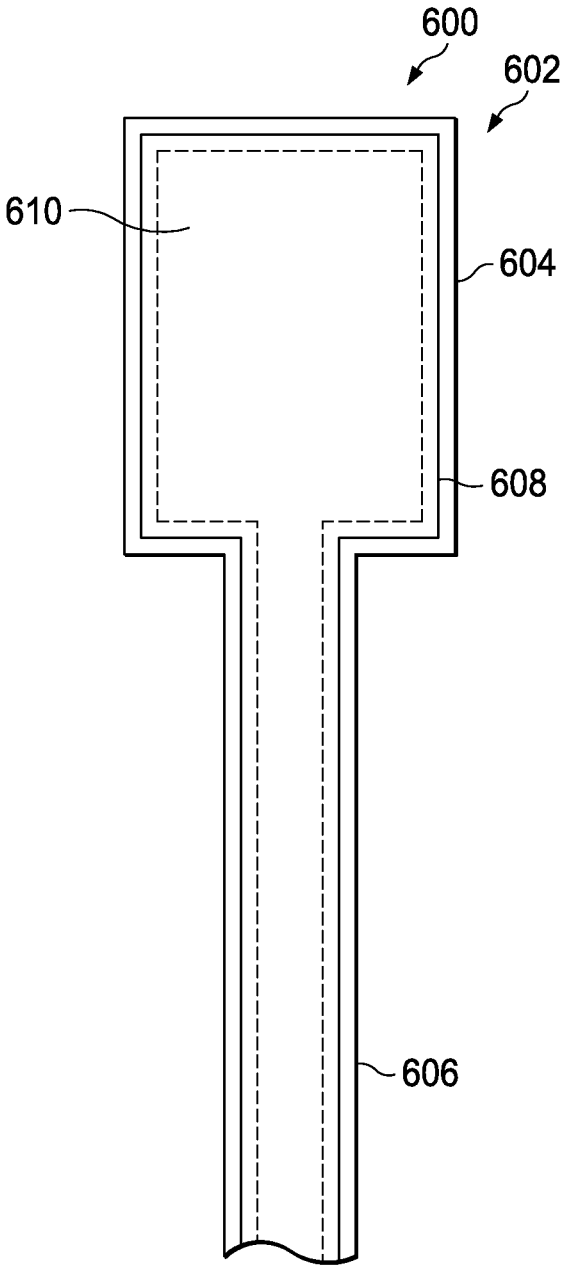
FIG. 6 is an illustration of an element for a tool in a tool system in accordance with an illustrative embodiment.

With reference now to FIG. 6, an illustration of an element for a tool in a tool system is depicted in accordance with an illustrative embodiment. In this illustrative example, element 600 may be an example of an element in plurality of elements 412 in FIG. 4. Element 600 may take the form of pin 602 in plurality of pins 414 in FIG. 4.

As depicted in this example, pin 602 may have head 604 and post 606 connected to head 604. Post 606 may be connected to heating system 408 in FIG. 4. Post 606 may have channel 608. Channel 608 may be configured to receive air 610.

In this illustrative example, air 610 may be air that has been heated to a selected temperature by heating system 408 in FIG. 4. The selected temperature for air 610 may be selected such that pin 602 may be heated and/or cooled to meet a temperature profile for pin 602. In other illustrative examples, a liquid or inert gas may be used instead of air 610 to heat and/or cool pin 602.

The temperature profile for pin 602 may be a specification of the temperature to which pin 602 should be heated based on a number of factors. These factors may include, for example, without limitation, time, a location of pin 602 in plurality of pins 414 in FIG. 4, and/or other suitable factors. In these depicted examples, other pins in plurality of pins 414 in FIG. 4 may be heated and/or cooled in a similar manner to pin 602.

Figure 7:
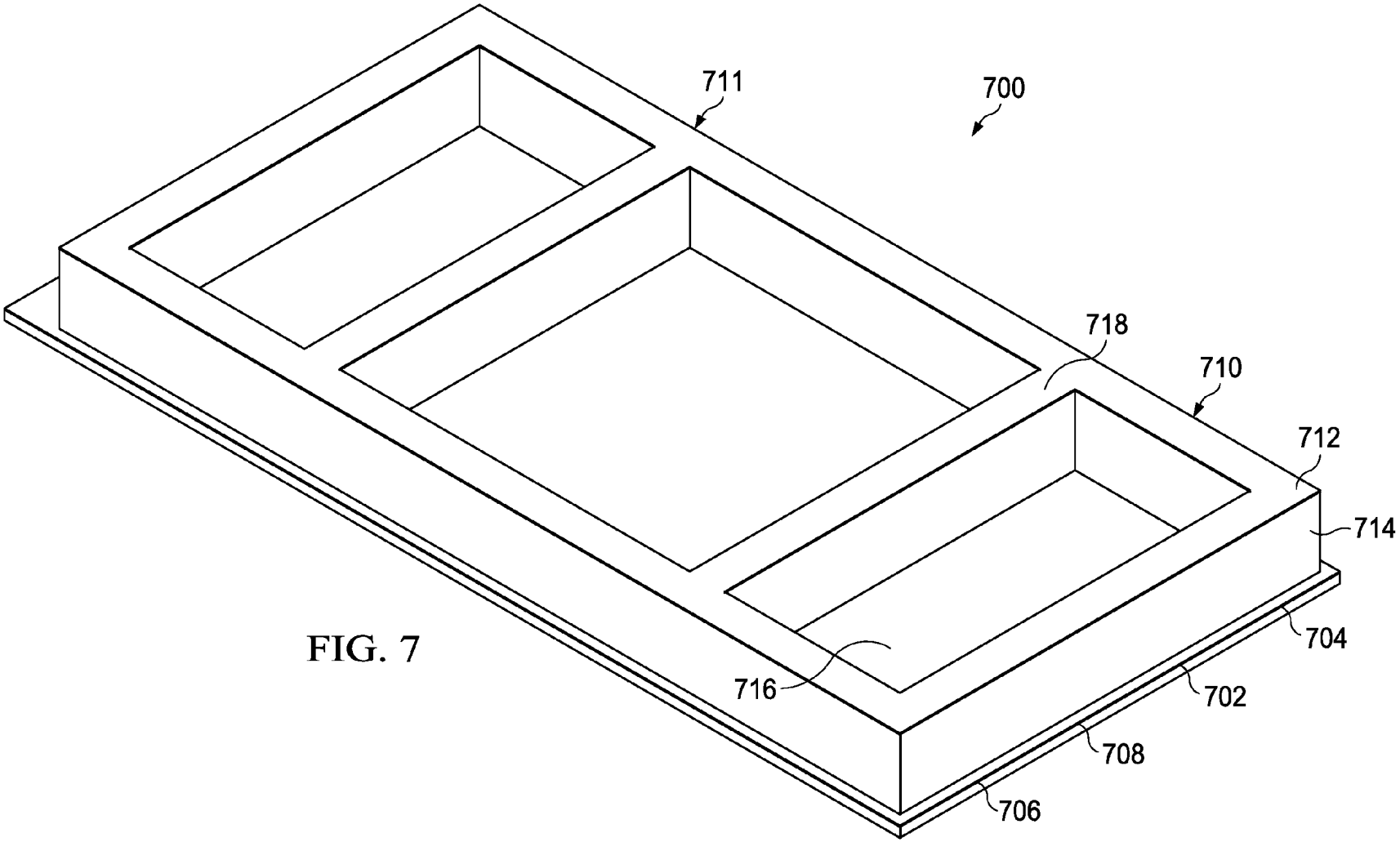
FIG. 7 is an illustration of a partially-processed workpiece in accordance with an illustrative embodiment.

With reference now to FIG. 7, an illustration of a partially-processed workpiece is depicted in accordance with an illustrative embodiment. In this illustrative example, workpiece 700 may be an example of workpiece 306 in FIG. 3. Additionally, workpiece 700 may be an example of a workpiece that may be processed using tool system 400 in FIG. 4.

As depicted in this illustrative example, workpiece 700 may have surface 702 on first side 704 and a second side (not shown in this view) of workpiece 700. Workpiece 700 may take the form of substrate 706 in this depicted example. In particular, substrate 706 may take the form of metal plate 708.

In this illustrative example, features 710 may be formed on surface 702 of workpiece 700. Features 710 may have been formed using tool system 400 in FIG. 4. Features 710 may take the form of walls 711 in this example. Additionally, walls 711 may be comprised of material 712. Material 712 may be metal 714 in this depicted example. As depicted in this example, surface 702 of workpiece 700 on first side 704 may comprise surface 716 of metal plate 708 and surfaces 718 of walls 711.

Figure 8:
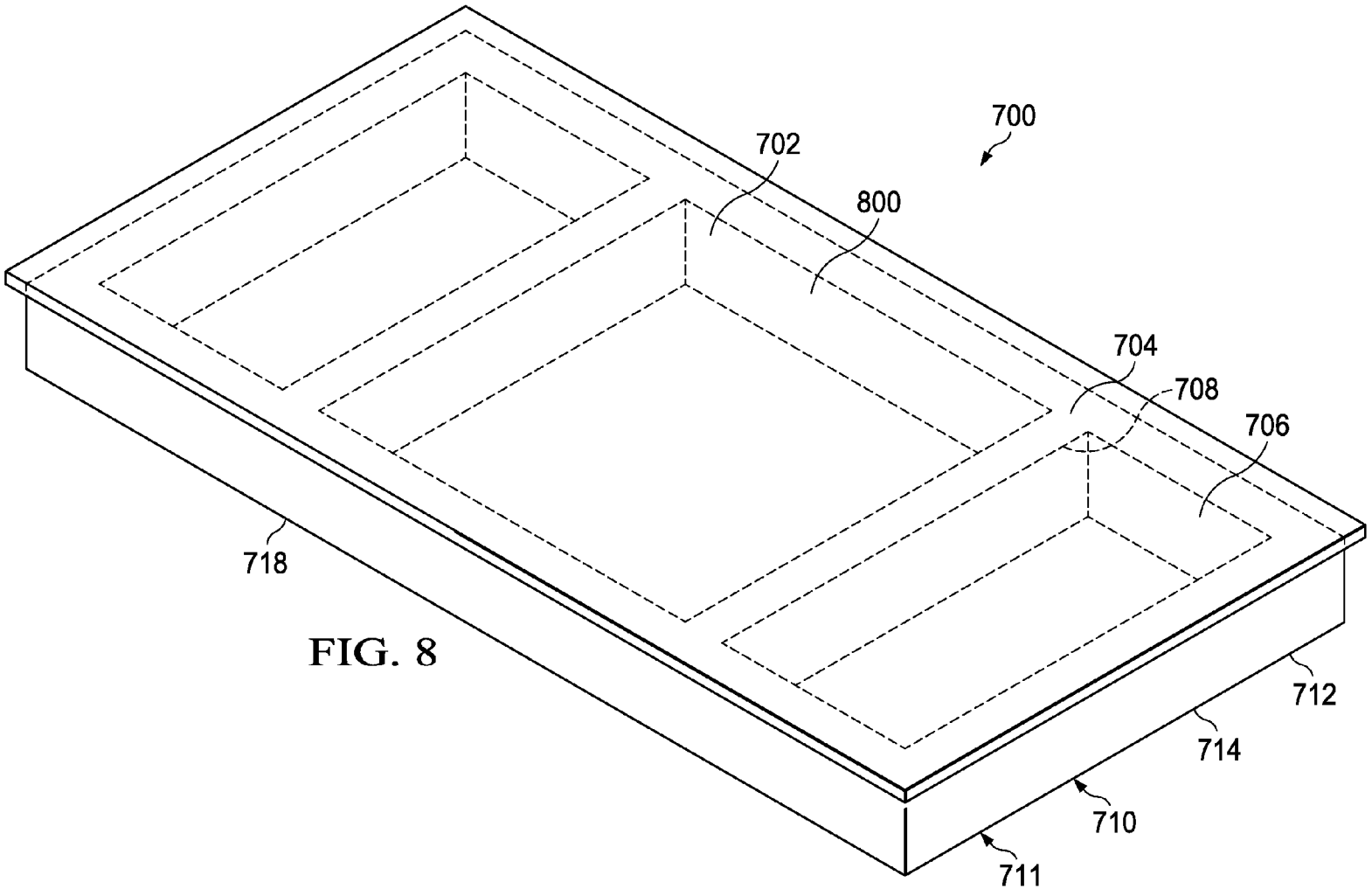
FIG. 8 is an illustration of a partially-processed workpiece in accordance with an illustrative embodiment.

With reference now to FIG. 8, an illustration of a partially-processed workpiece is depicted in accordance with an illustrative embodiment. In this illustrative example, workpiece 700 in FIG. 7 may be depicted turned over such that surface 702 on second side 800 of workpiece 700 may be seen.

Figure 9:
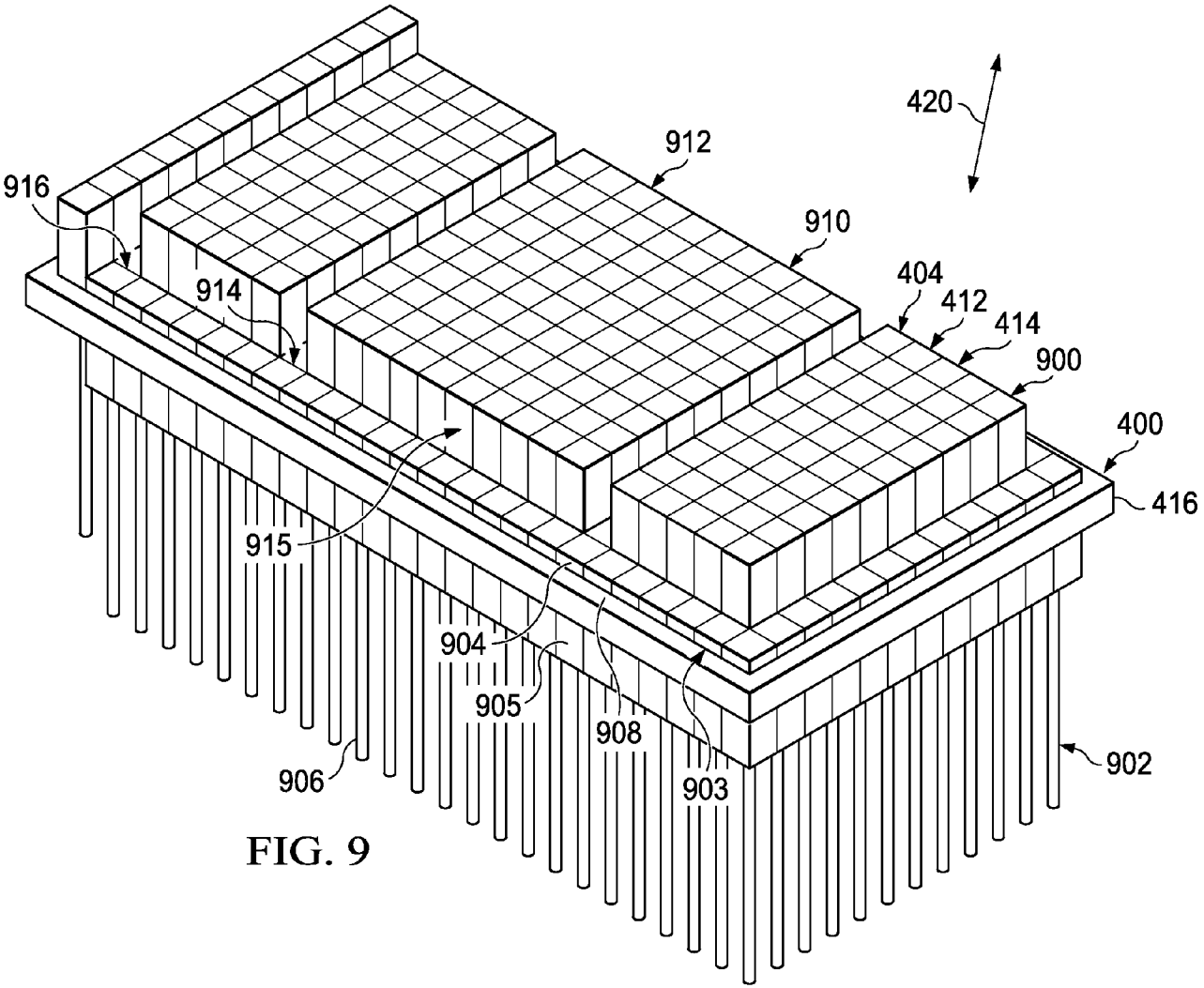
FIG. 9 is an illustration of a portion of a tool system configured for a workpiece in accordance with an illustrative embodiment.

With reference now to FIG. 9, an illustration of a portion of a tool system configured for a workpiece is depicted in accordance with an illustrative embodiment. In this illustrative example, tool 404 for tool system 400 in FIG. 4 may be configured to receive first side 704 of workpiece 700 in FIG. 7. In particular, tool 404 may be configured to receive first side 704 with features 710 on surface 702 of first side 704.

As depicted, plurality of pins 414 may have plurality of heads 900 and plurality of posts 902. Plurality of posts 902 may be configured to move within plurality of channels 903 in base 416. For example, without limitation, pin 904 in plurality of pins 414 may have head 905 and post 906. Pin 904 with head 905 and post 906 may move in the direction of axis 420. Post 906 may move within channel 908 in plurality of channels 903.

In this illustrative example, first portion 910 of plurality of pins 414 may be moved to height 912 relative to base 416. Further, second portion 914 of plurality of pins 414 may be moved to height 916 relative to base 416. With first portion 910 at height 912 and second portion 914 at height 916, plurality of pins 414 may be in positioned state 915. Movement of first portion 910 and second portion 914 of plurality of pins 414 may be performed using positioning system 406 for tool system 400 in FIG. 4.

Height 912 for first portion 910 of plurality of pins 414 may be selected such that first portion 910 may come into contact with surface 716 of metal plate 708 when first side 704 of metal plate 708 in FIG. 7 is placed over plurality of pins 414. Additionally, height 916 for second portion 914 of plurality of pins 414 may be selected such that second portion 914 may come into contact with surfaces 718 of walls 711 in FIG. 7 when first side 704 of metal plate 708 is placed over plurality of pins 414. In this manner, plurality of pins 414 may be adjusted in height to substantially conform to surface 702 of workpiece 700.

Figure 10:
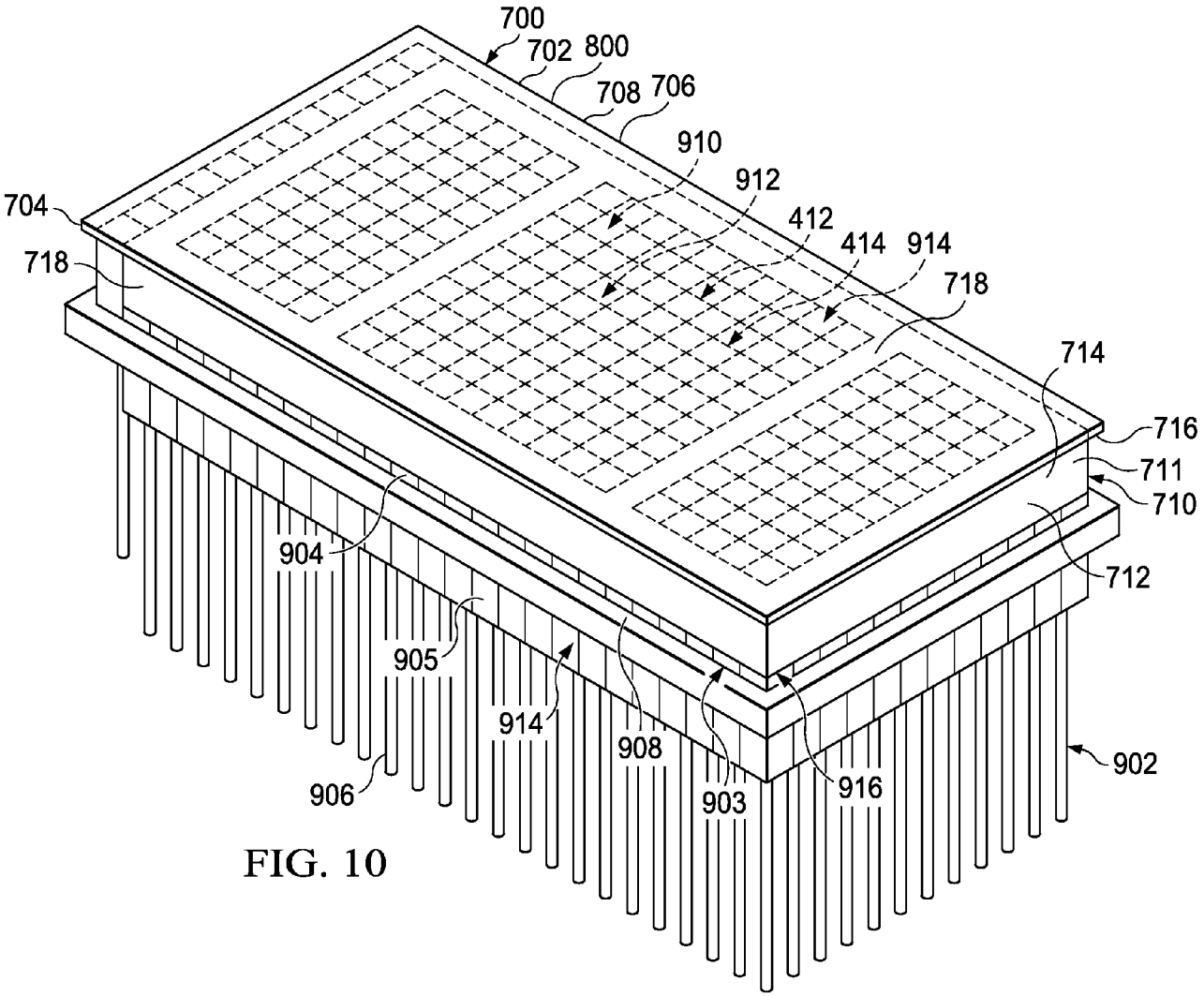
FIG. 10 is an illustration of a phantom view of a workpiece placed on a tool for a tool system in accordance with an illustrative embodiment.

With reference now to FIG. 10, an illustration of a phantom view of a workpiece placed on a tool for a tool system is depicted in accordance with an illustrative embodiment. In this illustrative example, workpiece 700 in FIG. 8 may be placed on tool 404 for tool system 400 in FIG. 9. Metal plate 708 is shown in a phantom view in this example. With this view, the placement of plurality of pins 414 with respect to surface 702 may be more clearly seen.

In this depicted example, plurality of pins 414 may be in positioned state 915 in FIG. 9. In this manner, first side 704 of workpiece 700 may be placed over plurality of pins 414 configured to receive first side 704 of workpiece 700.

As depicted in this illustrative example, first portion 910 of plurality of pins 414 may substantially conform to surface 716 of metal plate 708 when workpiece 700 is placed over tool 404. Further, second portion 914 of plurality of pins 414 may contact surfaces 718 of walls 711 when workpiece 700 is placed over tool 404.

Figure 11:
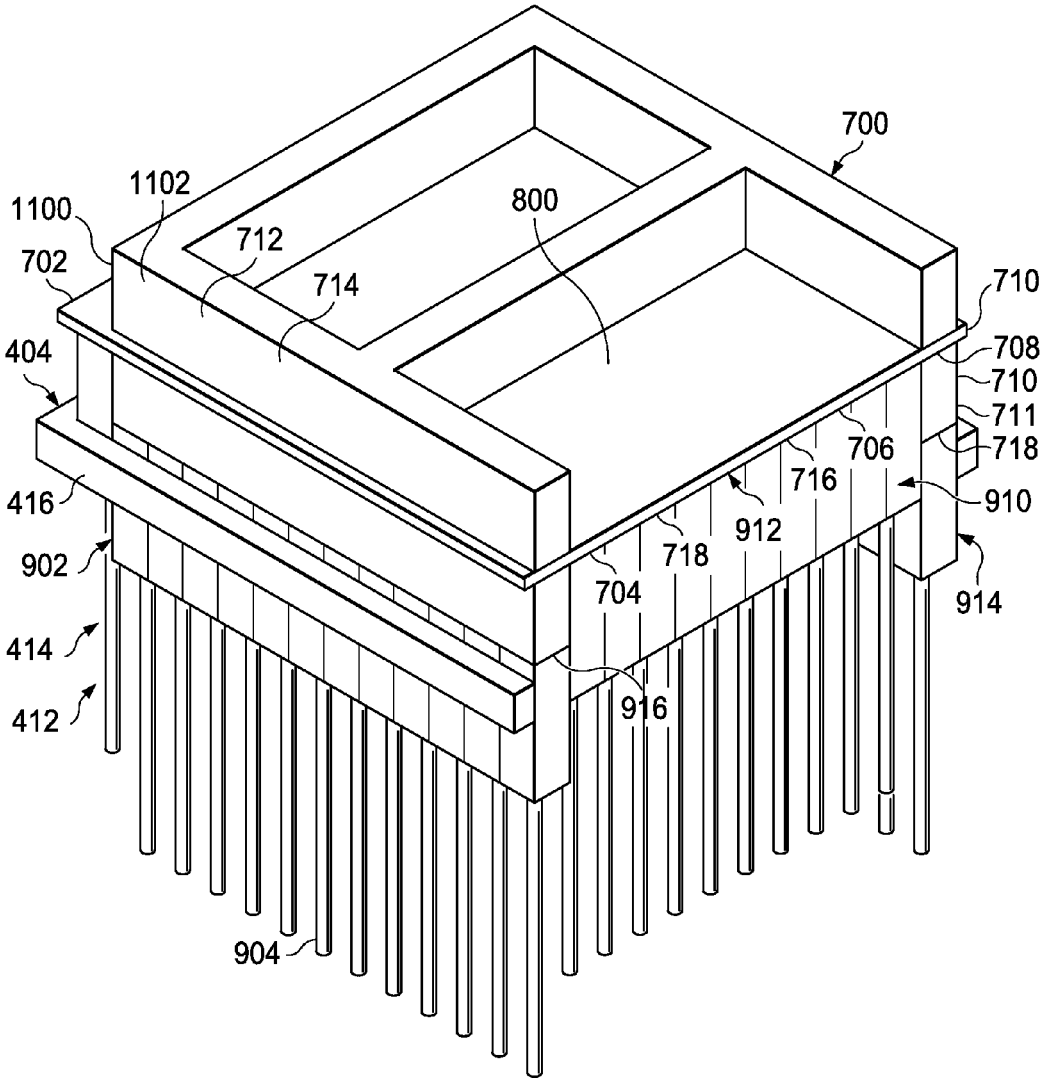
FIG. 11 is an illustration of a cross-sectional view of a workpiece placed on a tool for a tool system in accordance with an illustrative embodiment.

With reference now to FIG. 11, an illustration of a cross-sectional view of a workpiece placed on a tool for a tool system is depicted in accordance with an illustrative embodiment. In this illustrative example, features 1100 have been formed on surface 702 on second side 800 of workpiece 700. Features 1100 may take the form of walls 1102 formed from material 712 in the form of metal 714.

As depicted in this example, at height 912, first portion 910 of plurality of pins 414 may be in contact with surface 716 of metal plate 708. At height 916, second portion 914 of plurality of pins 414 may be in contact with surfaces 718 of walls 711.

Further, first portion 910 may be in contact with all of the sides of walls 711 in this illustrative example. The heads of first portion 910 of plurality of pins 414 may have a length that allows first portion 910 to be in contact with the sides of walls 711.

Figure 12:
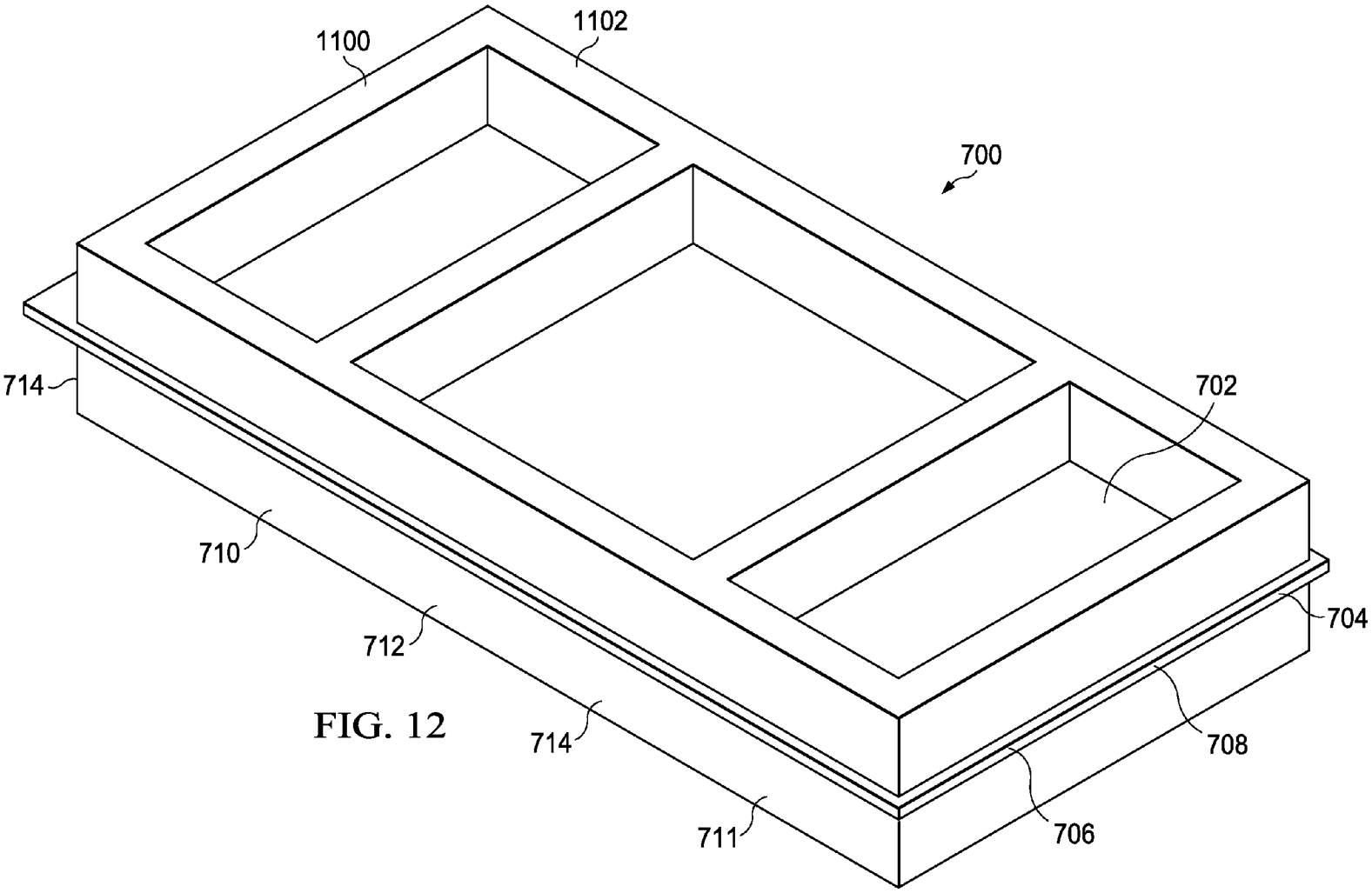
FIG. 12 is an illustration of a fully-processed workpiece in accordance with an illustrative embodiment.

With reference now to FIG. 12, an illustration of a fully-processed workpiece is depicted in accordance with an illustrative embodiment. In this illustrative example, workpiece 700 has been fully processed using tool system 400 in FIG. 4. As depicted, workpiece 700 may have walls 711 and walls 1102 formed on surface 702 of workpiece 700.

Figure 13:
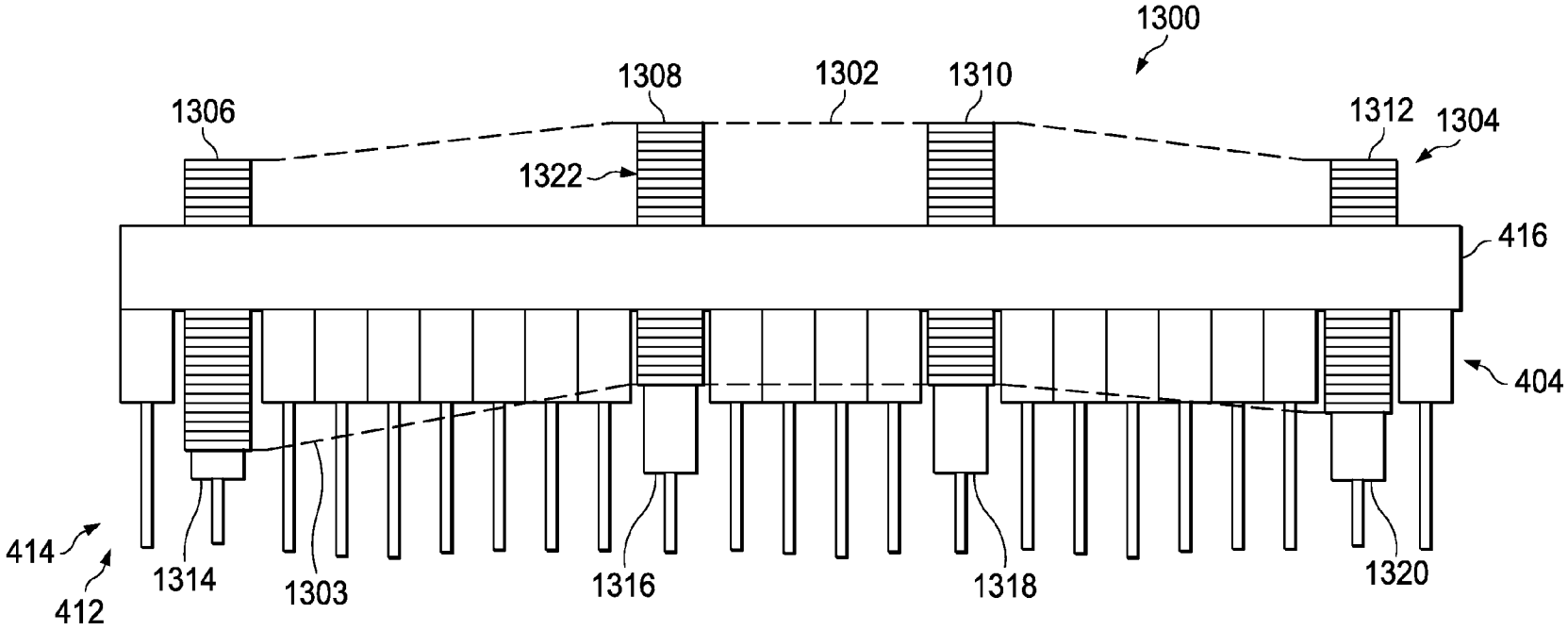
FIG. 13 is an illustration of an exposed cross-sectional view of a workpiece placed on a tool for a tool system in accordance with an illustrative embodiment.

With reference now to FIG. 13, an illustration of an exposed cross-sectional view of a workpiece placed on a tool for a tool system is depicted in accordance with an illustrative embodiment. In this illustrative example, workpiece 1300 may be placed on tool 404 for tool system 400 in FIG. 4.

As depicted, workpiece 1300 may have surface 1302. Surface 1302 may be curved surface 1303. Features 1304 may be formed on surface 1302. Features 1304 may include features 1306, 1308, 1310, and 1312. Pins 1314, 1316, 1318, and 1320 may be adjusted to substantially conform to the surfaces of features 1306, 1308, 1310, and 1312. In this illustrative example, features 1304 may be comprised of layers of metal 1322.

Each of plurality of pins 414 may be adjusted in height such that plurality of pins 414 substantially conform to curved surface 1303. Plurality of pins 414 may be heated to heat workpiece 1300 when plurality of pins 414 are in contact with curved surface 1303 of workpiece 1300.

Figure 14:
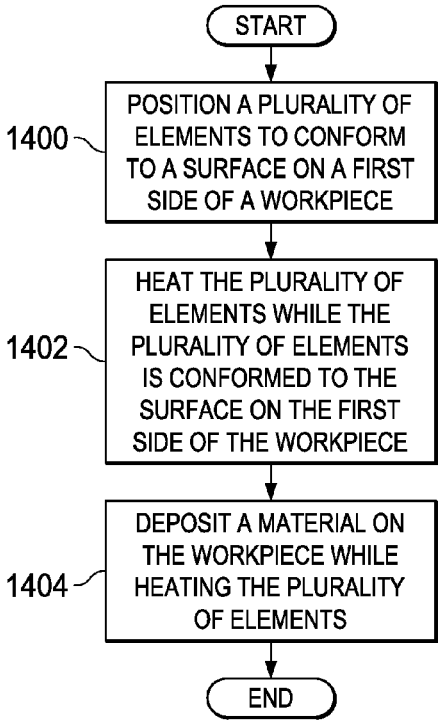
FIG. 14 is an illustration of a flowchart of a process for manufacturing an object in accordance with an illustrative embodiment.

With reference now to FIG. 14, an illustration of a flowchart of a process for manufacturing an object is depicted in accordance with an illustrative embodiment. The process illustrated in FIG. 14 may be implemented using tool system 308 to process workpiece 306 in FIG. 3 to manufacture the object.

The process may begin by positioning plurality of elements 328 to substantially conform to surface 330 on first side 332 of workpiece 306 (operation 1400). Plurality of elements 328 may be part of tool 320 in tool system 308.

Thereafter, plurality of elements 328 may be heated while plurality of elements 328 is substantially conformed to surface 330 on first side 332 of workpiece 306 (operation 1402). The heating of plurality of elements 328 may be performed using heating system 324. Heating plurality of elements 328 may heat workpiece 306 such that workpiece 306 meets desired temperature profile 338. The process may then deposit material 312 on workpiece 306 while heating plurality of elements 328 (operation 1404), with the process terminating thereafter.

Figure 15:
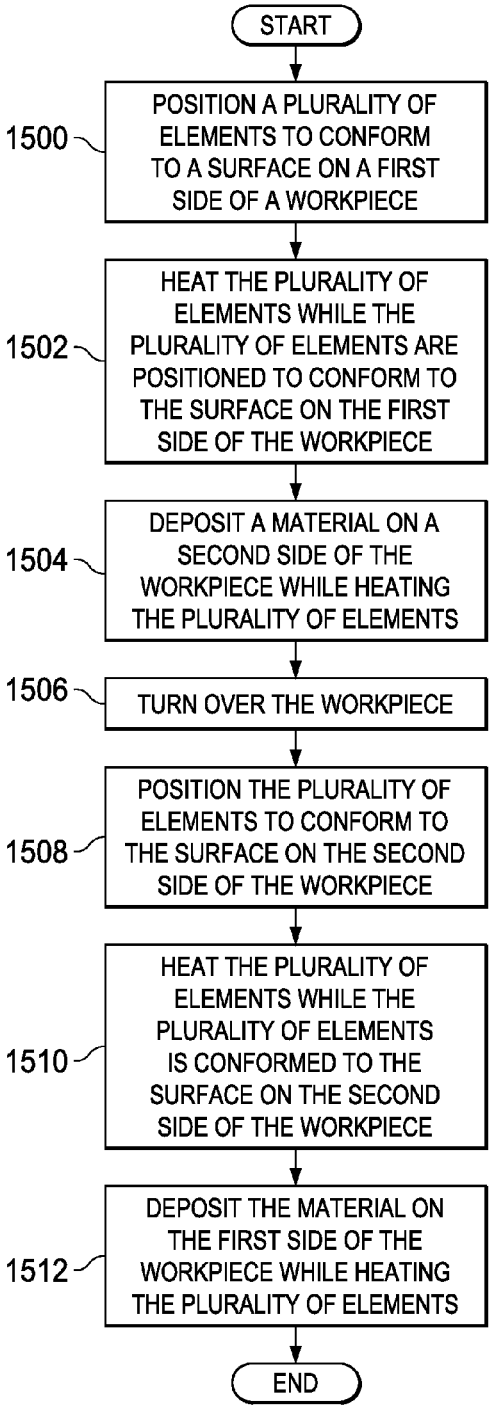
FIG. 15 is an illustration of a flowchart of a process for manufacturing an aircraft part in accordance with an illustrative embodiment.

With reference now to FIG. 15, an illustration of a flowchart of a process for manufacturing an aircraft part is depicted in accordance with an illustrative embodiment. The process illustrated in FIG. 15 may be implemented using tool system 308 to process workpiece 306 in FIG. 3 to manufacture the object. In this illustrative example, workpiece 306 may be an aircraft part.

The process may begin by positioning plurality of elements 328 to substantially conform to surface 330 on first side 332 of workpiece 306 (operation 1500). The process may then heat plurality of elements 328 while plurality of elements 328 are positioned to substantially conform to surface 330 on first side 332 of workpiece 306 (operation 1502).

Thereafter, the process may deposit material 312 on second side 382 of workpiece 306 while heating plurality of elements 328 (operation 1504). Second side 382 may be opposite to first side 332 of workpiece 306. In operation 1504, the deposition of material 312 may form second number of features 383 on second side 382 of workpiece 306.

The process may then turn over workpiece 306 (operation 1506). In operation 1506, workpiece 306 may be turned over to position first side 332 of workpiece 306 for the deposition of material 312.

Next, the process may position plurality of elements 328 to substantially conform to surface 330 on second side 382 of workpiece 306 (operation 1508). For example, without limitation, a first portion of plurality of elements 328 may be positioned at a first height, and a second portion of plurality of elements 328 may be positioned at a second height.

The first height may be selected such that the first portion of plurality of elements 328 may substantially conform to second number of surfaces 387 for second number of features 383. The second height may be selected such that the second portion of plurality of elements 328 may substantially conform to surface 384 of metal plate 314.

The process may heat plurality of elements 328 while plurality of elements 328 is substantially conformed to surface 330 on second side 382 of workpiece 306 (operation 1510). Thereafter, the process may deposit material 312 on first side 332 of workpiece 306 while heating plurality of elements 328 (operation 1512), with the process terminating thereafter.

In this illustrative example, during operations 1504 and 1512, the process may maintain desired temperature profile 338 for workpiece 306 by changing a temperature profile for plurality of elements 328. For example, without limitation, the process may perform at least one of cooling at least a portion of plurality of elements 328 and heating at least a portion of plurality of elements 328.

Figure 16:
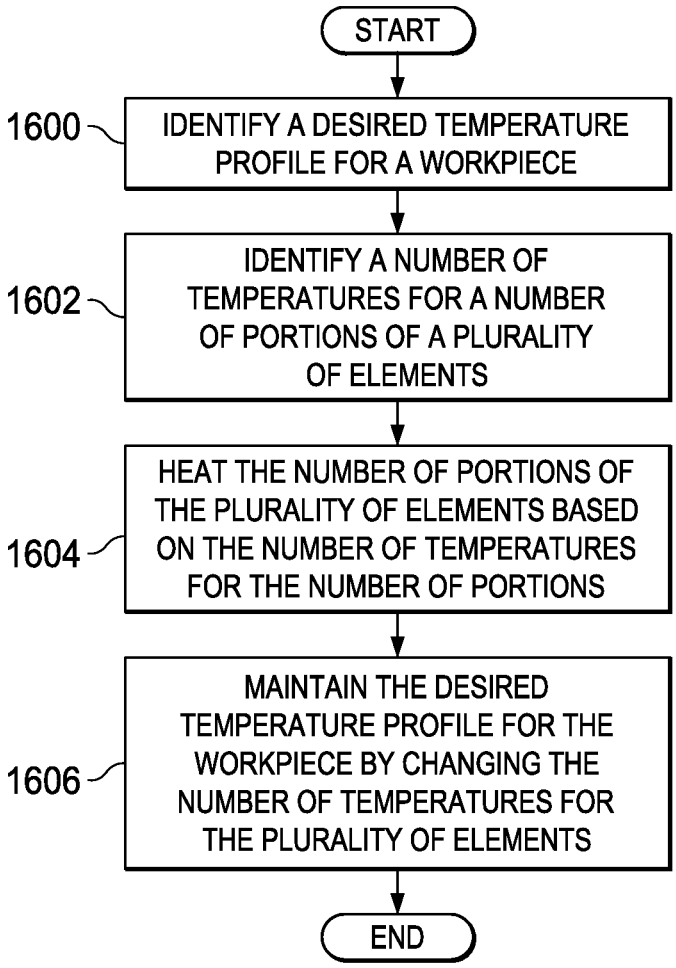
FIG. 16 is an illustration of a flowchart of a process for heating a plurality of elements in accordance with an illustrative embodiment.

With reference now to FIG. 16, an illustration of a flowchart of a process for heating a plurality of elements is depicted in accordance with an illustrative embodiment. The process illustrated in FIG. 16 may be implemented using heating system 324 for tool system 308 to heat plurality of elements 328 in FIG. 3. This process may be implemented to heat workpiece 306 to meet desired temperature profile 338 in FIG. 3.

The process may begin by identifying desired temperature profile 338 for workpiece 306 (operation 1600). Desired temperature profile 338 may include a specification of temperatures for different portions of workpiece 306. These temperatures may be individual temperatures, temperature ranges, and/or may include tolerances, depending on the particular implementation.

Additionally, desired temperature profile 338 may include a specification of temperatures for different portions of workpiece 306 based on time, locations of the different portions, and/or the particular stage of processing for workpiece 306. In this illustrative example, different portions of workpiece 306 may be heated to different temperatures, for example, without limitation.

The process may then identify a number of temperatures for a number of portions of plurality of elements 328 (operation 1602). Each of the number of portions of plurality of elements 328 may include elements that are in contact with a different portion of workpiece 306 to be heated to a particular temperature using desired temperature profile 338.

Thereafter, the process may heat the number of portions of plurality of elements 328 based on the number of temperatures for the number of portions (operation 1604). Operation 1604 may include heating and/or cooling the number of portions of plurality of elements 328 to meet the number of temperatures in desired temperature profile 338. In this manner, workpiece 306 may be heated to desired temperature profile 338.

The process may then maintain desired temperature profile 338 for workpiece 306 by changing the number of temperatures for plurality of elements 328 (operation 1606), with the process terminating thereafter. In operation 1606, elements in plurality of elements 328 may be heated and/or cooled to meet desired temperature profile 338.

Further, in operation 1606, changing the number of temperatures for plurality of elements 328 may include changing the configuration of the number of portions of plurality of elements 328 and/or the temperature to which each of the number of portions of plurality of elements 328 is heated. Operation 1606 may be performed until processing of the workpiece is completed.

The flowcharts and block diagrams in the different depicted embodiments illustrate the architecture, functionality, and operation of some possible implementations of apparatus and methods in different illustrative embodiments. In this regard, each block in the flowcharts or block diagrams may represent a module, segment, function, and/or a portion of an operation or step.

In some alternative implementations, the function or functions noted in the block may occur out of the order noted in the figures. For example, in some cases, two blocks shown in succession may be executed substantially concurrently, or the blocks may sometimes be executed in the reverse order, depending upon the functionality involved. Also, other blocks may be added in addition to the illustrated blocks in a flowchart or block diagram.

For example, without limitation, in FIG. 15, operation 1502 and operation 1504 may be performed at the same time. Similarly, operation 1508 and operation 1510 may be performed at the same time.

Thus, the different illustrative embodiments provide a method and apparatus for processing workpieces. A plurality of elements may be positioned to substantially conform to a surface on a first side of a workpiece. Heating may be performed to heat the plurality of elements, while the plurality of elements is substantially conformed to the surface of the first side of the workpiece. A material may then be deposited on the workpiece, while heating the plurality of elements.

The different illustrative embodiments may provide a method and apparatus for processing workpieces that may take less time and/or effort. Further, the cost of processing the workpieces may be reduced.

The different illustrative embodiments also may provide a method and apparatus for manufacturing an object may be provided. A plurality of elements may be positioned to substantially conform to a surface on a first side of a workpiece. The plurality of elements may be heated while the plurality of elements is substantially conformed to the surface on the first side of the workpiece. A material may be deposited on the workpiece while heating the plurality of elements.

In some examples, the step of heating the plurality of elements, while the plurality of elements is substantially conformed to the surface on the first side of the workpiece, comprises heating the plurality of elements while the plurality of elements is substantially conformed to the surface on the first side of the workpiece, wherein the plurality of elements is heated to meet a temperature profile selected to reduce distortions in the workpiece. In some examples, the step of depositing the material on the workpiece, while heating the plurality of elements, comprises depositing the material on a second side of the workpiece wherein the first side of the workpiece is opposite to the second side of the workpiece.

In other illustrative examples, the method may further wait for a period of time and deposit an additional material on the workpiece after the period of time. In some illustrative examples, the workpiece may be turned over. The plurality of elements may be positioned to substantially conform to a surface on a second side of the workpiece. The plurality of elements may be heated while the plurality of elements is substantially conformed to the surface on the second side of the workpiece. The material may be deposited on the workpiece while heating the plurality of elements.

In some illustrative examples, a desired temperature profile for the workpiece may be maintained by changing a temperature profile for the plurality of elements. In some illustrative examples, the maintaining step comprises cooling at least a portion of the plurality of elements. In some illustrative examples, the maintaining step comprises heating at least a portion of the plurality of elements.

In some illustrative examples, the method may further comprise measuring a distortion in the workpiece after depositing the material. In some illustrative examples, the surface comprises a planar surface of a plate and a wall extending from the plate. In some illustrative examples, the workpiece is comprised of at least one of a metal, a metal alloy, aluminum, titanium, a plastic, or a composite material. In some illustrative examples, the material is selected from one of a metal, a metal alloy, titanium, aluminum, a resin, or a plastic. In some illustrative examples, the workpiece is an aircraft part.

In an illustrative embodiment, a method may be provided for manufacturing an aircraft part. A plurality of elements may be positioned to substantially conform to a surface on a first side of the aircraft part. The surface may comprise a planar surface of a plate and a wall extending from the plate. The aircraft part may be comprised of at least one of a metal, a metal alloy, aluminum, titanium, a plastic, or a composite material. The plurality of elements may be heated while the plurality of elements is substantially conformed to the surface on the first side of the aircraft part. The plurality of elements may be heated to meet a desired temperature profile selected to reduce distortions in the aircraft part. A material may be deposited on a second side of the aircraft part while heating the plurality of elements. The material may be selected from one of a metal, a metal alloy, titanium, aluminum, a resin, or a plastic. The aircraft part may be turned over. The plurality of elements may be positioned to substantially conform to a surface on the second side of the aircraft part. The first side of the aircraft part may be opposite to the second side of the aircraft part. The plurality of elements may be heated while the plurality of elements is substantially conformed to the surface on the second side of the aircraft part. The material may be deposited on the first side of the aircraft part while heating the plurality of elements. The desired temperature profile for the aircraft part may be maintained by changing a temperature profile for the plurality of elements by performing at least one of cooling at least a first portion of the plurality of elements and heating at least a second portion of the plurality of elements.

In yet another illustrative embodiment, an apparatus may comprise a plurality of elements configured to move relative to each other, a positioning system, and a heating system. The positioning system may be configured to move the plurality of elements to substantially conform to a surface on a first side of a workpiece in a positioned state. The heating system may be configured to heat the plurality of elements while the plurality of elements is substantially conformed to the surface on the first side of the workpiece.

In some illustrative examples, the heating system may be configured to heat the plurality of elements while the plurality of elements is substantially conformed to the surface on the first side of the workpiece to meet a temperature profile selected to reduce distortions in the workpiece. In some illustrative examples, the apparatus may further comprise a material deposition system configured to deposit a material on the first side of the workpiece and a second side of the workpiece. In some illustrative examples, the surface of the workpiece may comprise a planar surface of a plate and a wall extending from the plate. In some illustrative examples, the plurality of elements may heat the workpiece such that a difference between a first temperature of the workpiece and a second temperature of a material is reduced. In some illustrative examples, the plurality of elements may heat the workpiece such that a number of thermal stresses in the workpiece is reduced. In some illustrative examples, a distortion in the workpiece may be reduced. In some illustrative examples, the workpiece may be comprised of at least one of a metal, a metal alloy, aluminum, titanium, a plastic, or a composite material. In some illustrative examples, the material may be selected from one of a metal, a metal alloy, titanium, aluminum, resin, or a plastic. In some illustrative examples, the workpiece may be an aircraft part.

In still yet another illustrative embodiment, an aircraft part manufacturing system may comprise a plurality of elements configured to move relative to each other, a positioning system, a heating system, and a material deposition system. The positioning system may be configured to move the plurality of elements to substantially conform to a surface on a first side of an aircraft part in a positioned state. The surface of the aircraft part may comprise a planar surface of a plate and a wall extending from the plate. The aircraft part may be comprised of at least one of a metal, a metal alloy, aluminum, titanium, a plastic, or a composite material. The heating system may be configured to heat the plurality of elements while the plurality of elements is substantially conformed to the surface on the first side of the aircraft part to meet a temperature profile selected to reduce distortions in the aircraft part. The plurality of elements may heat the aircraft part such that a difference between a first temperature of the aircraft part and a second temperature of the material is reduced and such that a number of thermal stresses in the aircraft part are reduced. The material deposition system may be configured to deposit a material on the first side of the aircraft part and on a second side of the aircraft part. The material may be selected from one of a metal, a metal alloy, titanium, aluminum, a resin, and a plastic.

Figure 17:
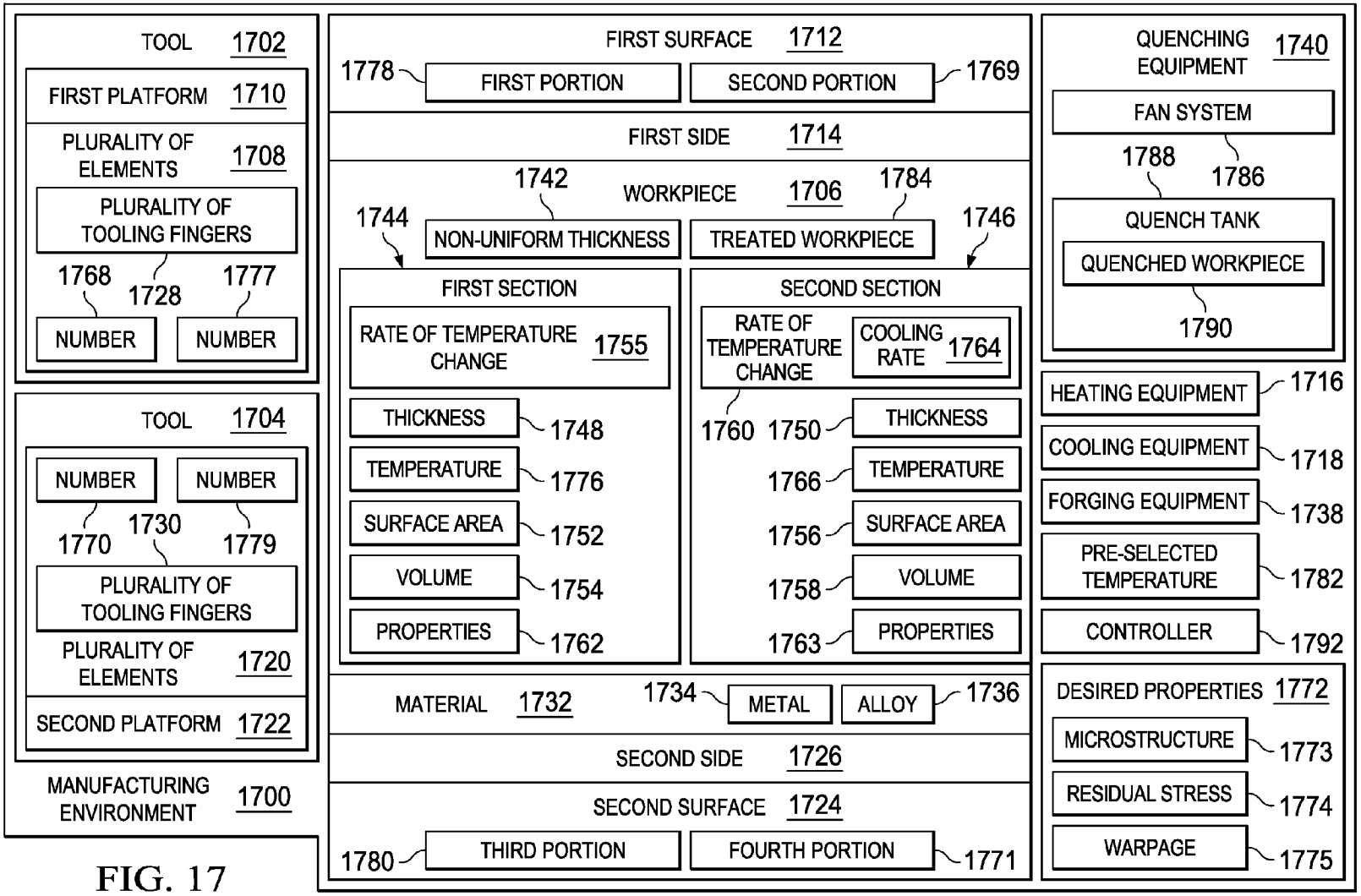
FIG. 17 is an illustration of a manufacturing environment in the form of a block diagram in accordance with an illustrative embodiment.

With reference to FIGS. 17-24, a method and apparatus for processing a metal workpiece is presented. Turning now to FIG. 17, an illustration of a manufacturing environment is depicted in the form of a block diagram in accordance with an illustrative embodiment. Manufacturing environment 1700 may be another illustrative example of manufacturing environment 300 of FIG. 3.

Manufacturing environment 1700 includes tool 1702, tool 1704, and workpiece 1706. Tool 1702 may have plurality of elements 1708 associated with first platform 1710. In some illustrative examples, tool 1702 may be tool 320 of FIG. 3.

Plurality of elements 1708 may be configured to move relative to each other. In other words, elements in plurality of elements 1708 may all move together and/or individually with respect to other elements in plurality of elements 1708. Additionally, elements in plurality of elements 1708 may move the same distance and/or different distances as compared to other elements in plurality of elements 1708. Plurality of elements 1708 may substantially conform to and/or touch first surface 1712 of workpiece 1706 on first side 1714 of workpiece 1706.

At least one of heating equipment 1716 or cooling equipment 1718 may be associated with plurality of elements 1708. As a result, plurality of elements 1708 may be selectively heated or cooled as desired.

Tool 1704 may have plurality of elements 1720 associated with second platform 1722. In some illustrative examples, tool 1704 may be tool 320 of FIG. 3.

Plurality of elements 1720 may be configured to move relative to each other. In other words, elements in plurality of elements 1720 may all move together and/or individually with respect to other elements in plurality of elements 1720. Additionally, elements in plurality of elements 1720 may move the same distance and/or different distances as compared to other elements in plurality of elements 1720. Plurality of elements 1720 may substantially conform to and/or touch second surface 1724 of workpiece 1706 on second side 1726 of workpiece 1706.

At least one of heating equipment 1716 or cooling equipment 1718 may be associated with plurality of elements 1720. As a result, plurality of elements 1720 may be selectively heated or cooled as desired.

In some illustrative examples, plurality of elements 1708 may be referred to as plurality of tooling fingers 1728 or simply fingers. In some illustrative examples, plurality of elements 1720 may be referred to as plurality of tooling fingers 1730 or simply fingers.

Although manufacturing environment 1700 is depicted as having two tools, tool 1702 and tool 1704, in some illustrative examples, manufacturing environment 1700 may have a single tool. In these illustrative examples, both first platform 1710 and second platform 1722 may each be associated with the same tool, such as tool 1702 or tool 1704.

Workpiece 1706 may be formed of material 1732. Material 1732 may be selected from at least one of metal 1734, alloy 1736, or some other desirable material. Material 1732 may be heated to achieve a desirable shape or other characteristic for workpiece 1706. In some illustrative examples, material 1732 may be heated and forged using forging equipment 1738. After heating, material 1732 may be quenched using quenching equipment 1740.

Workpiece 1706 may have non-uniform thickness 1742. As a result of non-uniform thickness 1742, if workpiece 1706 is quenched immediately after at least one of heating or forging, workpiece 1706 may have undesirable characteristics such as warpage, residual stresses, or varying microstructure across workpiece 1706.

In this illustrative example, workpiece 1706 has first section 1744 and second section 1746. First section 1744 may have thickness 1748 and second section may have thickness 1750. In some illustrative examples, thickness 1750 may be greater than thickness 1748. First section 1744 may have surface area 1752 and volume 1754. At least one of thickness 1748, surface area 1752, or volume 1754 may influence rate of temperature change 1755 of first section 1744. Second section 1746 may have surface area 1756 and volume 1758. At least one of thickness 1750, surface area 1756, or volume 1758 may influence rate of temperature change 1760 of second section 1746.

In some illustrative examples, rate of temperature change 1755 may be greater than rate of temperature change 1760. Rate of temperature change 1755 and rate of temperature change 1760 may affect properties 1762 of first section 1744 and properties 1763 of second section 1746, respectively.

When rate of temperature change 1755 and rate of temperature change 1760 are different, properties 1762 and properties 1763 may be different. For example, when rate of temperature change 1755 and rate of temperature change 1760 are different, the microstructure of first section 1744 and second section 1746 may be different.

As one example, when workpiece 1706 is quenched, second section 1746 may cool more slowly than first section 1744 when thickness 1750 is greater than thickness 1748. As a result, rate of temperature change 1760 would be less than rate of temperature change 1755. When rate of temperature change 1760 is less than rate of temperature change 1755, upon quenching, different microstructures may result in first section 1744 and second section 1746.

To control properties 1763 of second section 1746, cooling rate 1764 may be controlled. In some illustrative examples, cooling rate 1764 may be controlled using at least one of plurality of elements 1708 or plurality of elements 1720.

To control cooling rate 1764 of second section 1746, temperature 1766 may be controlled using at least one of plurality of elements 1708 or plurality of elements 1720. For example, number 1768 of plurality of elements 1708 may contact second portion 1769 of first surface 1712. Second portion 1769 may be part of surface area 1756 of second section 1746. As another example, number 1770 of plurality of elements 1720 may contact fourth portion 1771 of second surface 1724. Fourth portion 1771 may be part of surface area 1756 of second section 1746. Number 1768 and number 1770 may be cooled by cooling equipment 1718. By reducing temperature 1766 using number 1768 and number 1770, cooling rate 1764 of second section 1746 may be controlled.

In some illustrative examples, temperature 1766 may be lowered until it reaches a pre-selected temperature. Specifically, temperature 1766 may be lowered to attain desired properties 1772. Desired properties 1772 may include microstructure 1773, residual stress 1774, and warpage 1775. It may be desirable to reduce or eliminate residual stress 1774. Further, it may be desirable for minimal warpage 1775 to be present in workpiece 1706. In some illustrative examples, desired properties 1772 may include a desired shape for workpiece 1706.

To control temperature 1776, number 1777 of plurality of elements 1708 may contact first portion 1778 of first surface 1712. First portion 1778 may be a part of surface area 1752. Number 1779 of plurality of elements 1720 may contact third portion 1780 of second surface 1724. Third portion 1780 may be a part of surface area 1752.

To achieve desired properties 1772 through the whole of workpiece 1706, temperature 1776 may be controlled by number 1777 and number 1779. Further, to achieve desired properties 1772 through the whole of workpiece 1706, temperature 1766 may be controlled by number 1768 and number 1770. In some illustrative examples, temperature 1766 may be brought to a pre-selected temperature by cooling number 1768 and number 1770 to a second temperature.

In some illustrative examples, temperature 1776 of first section 1744 may be maintained while temperature 1766 of second section 1746 is reduced. In some illustrative examples, first portion 1778 and third portion 1780 may be heated while temperature 1766 is reduced. In some illustrative examples, temperature 1776 may be reduced to pre-selected temperature 1782. Pre-selected temperature 1782 may be selected such that second section 1746 has desired properties 1772 after quenching.

After workpiece 1706 is heated, workpiece 1706 may be positioned between first platform 1710 and second platform 1722. Cooling rate 1764 of second section 1746 may then be controlled using plurality of elements 1708 and plurality of elements 1720. After controlling cooling rate 1764, workpiece 1706 may be referred to as treated workpiece 1784. Treated workpiece 1784 may then be quenched using quenching equipment 1740. By controlling cooling rate 1764, second section 1746 may be "pre-cooled" prior to quenching.

Quenching equipment 1740 may take the form of fan system 1786, quench tank 1788, or other desirable equipment. After quenching, workpiece 1706 may take the form of quenched workpiece 1790. As depicted quenched workpiece 1790 is present in quench tank 1788.

Controller 1792 may communicate with at least one of heating equipment 1716, cooling equipment 1718, tool 1702, or tool 1704. Controller 1792 may direct or control functions performed by heating equipment 1716, cooling equipment 1718, tool 1702, or tool 1704. In some illustrative examples, controller 1792 may direct or control movement of plurality of elements 1708 or plurality of elements 1720. In some illustrative examples, controller 1792 may direct or control heat or cooling provided to a number of at least one of plurality of elements 1708 or plurality of elements 1720.

Controller 1792 may control operations of at least one of heating equipment 1716, cooling equipment 1718, tool 1702, or tool 1704. Controller 1792 may be implemented in software, hardware, firmware or a combination thereof. When software is used, the operations performed by controller 1792 may be implemented in program code configured to run on a processor unit. When firmware is used, the operations performed by controller 1792 may be implemented in program code and data and stored in persistent memory to run on a processor unit. When hardware is employed, the hardware may include circuits that operate to perform the operations in controller 1792.

Figure 18:
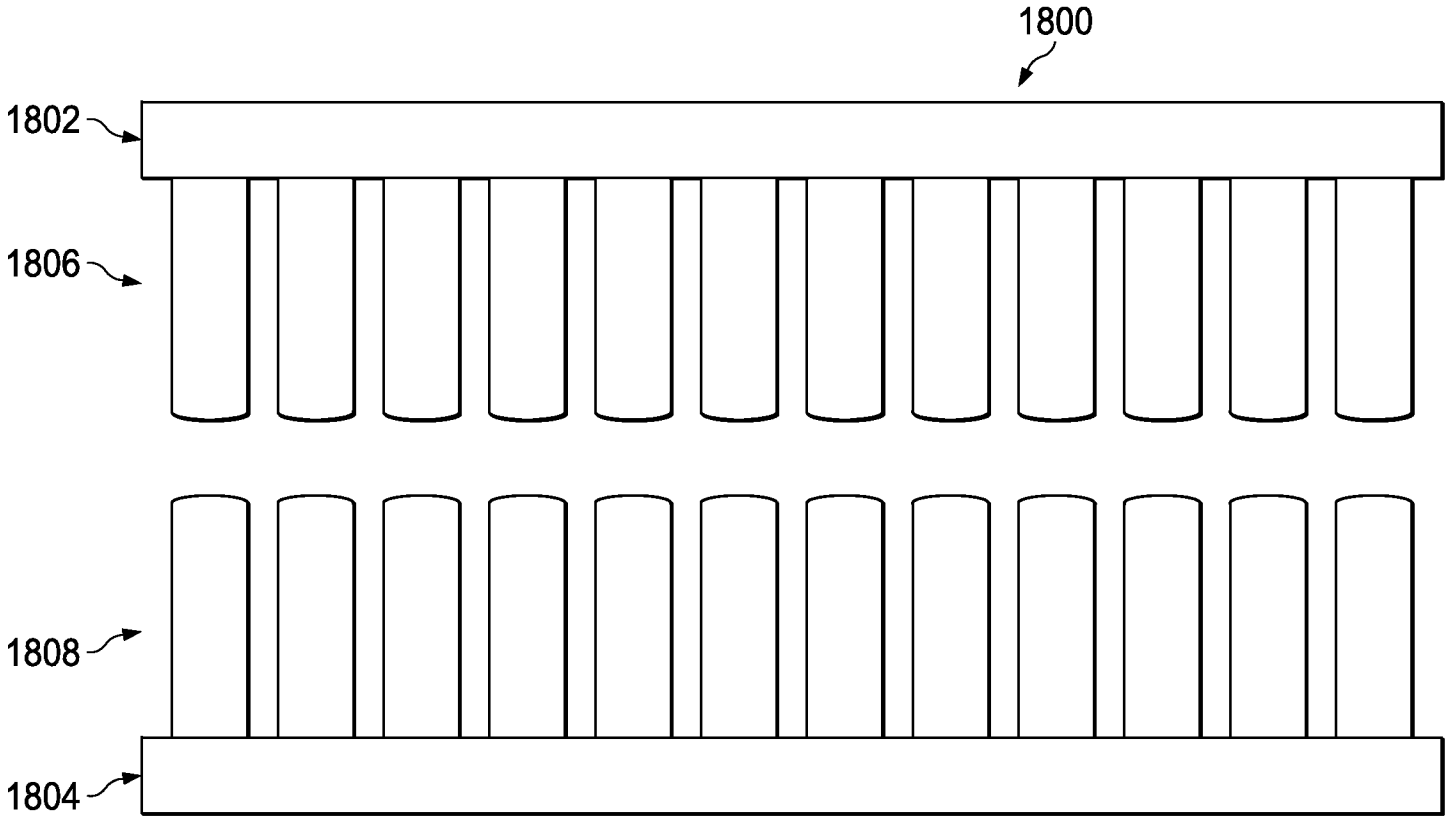
FIG. 18 is an illustration of a side view of a number of tools in accordance with an illustrative embodiment.

Turning now to FIG. 18, an illustration of a side view of a number of tools is depicted in accordance with an illustrative embodiment. View 1800 depicts first platform 1802 and second platform 1804. Plurality of elements 1806 are associated with first platform 1802. Plurality of elements 1806 may be a physical implementation of plurality of elements 1708 shown in block form in FIG. 17. Plurality of elements 1808 are associated with second platform 1804. Plurality of elements 1808 may be a physical implementation of plurality of elements 1720 shown in block form in FIG. 17.

Plurality of elements 1806 may be configured to move relative to each other. In other words, elements in plurality of elements 1806 may all move together and/or individually with respect to other elements in plurality of elements 1806. Additionally, elements in plurality of elements 1806 may move the same distance and/or different distances as compared to other elements in plurality of elements 1806.

Similarly, plurality of elements 1808 may be configured to move relative to each other. In other words, elements in plurality of elements 1808 may all move together and/or individually with respect to other elements in plurality of elements 1808. Additionally, elements in plurality of elements 1808 may move the same distance and/or different distances as compared to other elements in plurality of elements 1808.

Figure 19:
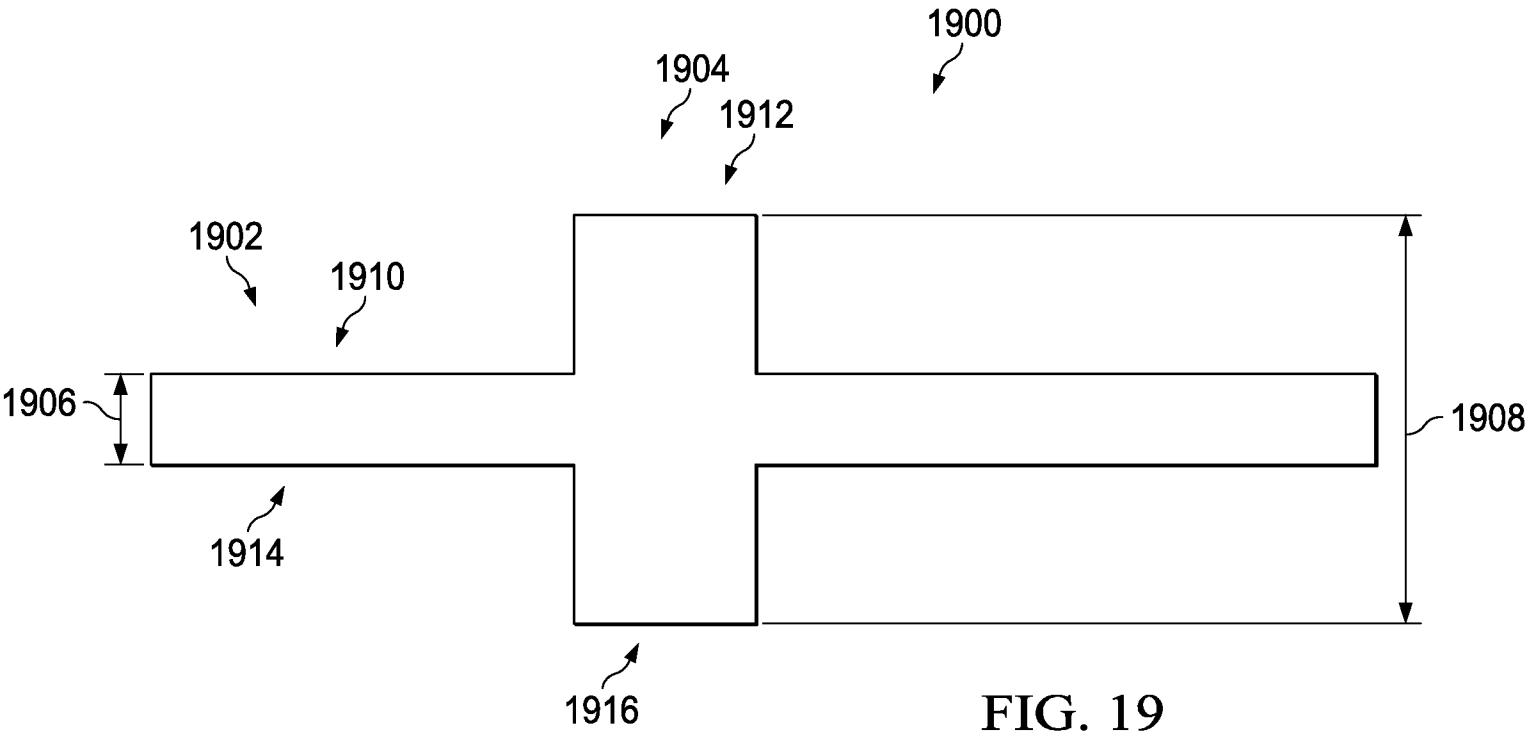
FIG. 19 is an illustration of a side view of a workpiece in accordance with an illustrative embodiment.

Turning now to FIG. 19, an illustration of a side view of a workpiece is depicted in accordance with an illustrative embodiment. Workpiece 1900 may be a physical implementation of workpiece 1706 shown in block form in FIG. 17.

Workpiece 1900 may have first section 1902 and second section 1904. First section 1902 may have thickness 1906 while second section 1904 has thickness 1908. First section 1902 may have surface area 1910. Second section 1904 may have surface area 1912. First section 1902 may have volume 1914 of material. Second section 1904 may have volume 1916 of material.

As a result of at least one of the difference between thickness 1906 and thickness 1908, the difference between surface area 1910 and surface area 1912, or the difference between volume 1914 and volume 1916, material in first section 1902 may cool faster than material in second section 1904. As a result of the rate of temperature change being greater in first section 1902 than in second section 1904, workpiece 1900 may warp during quenching. Further, as a result of the difference in the rates of temperature change between first section 1902 and second section 1904, workpiece 1900 may have residual stresses following quenching. Yet further, as a result of the difference in the rates of temperature change between first section 1902 and second section 1904, second section 1904 may not have the same microstructure as first section 1902. In some illustrative examples, as a result of the difference in the rates of temperature change between first section 1902 and second section 1904, the material properties of second section 1904 may be less desirable than the material properties of first section 1902.

Figure 20:
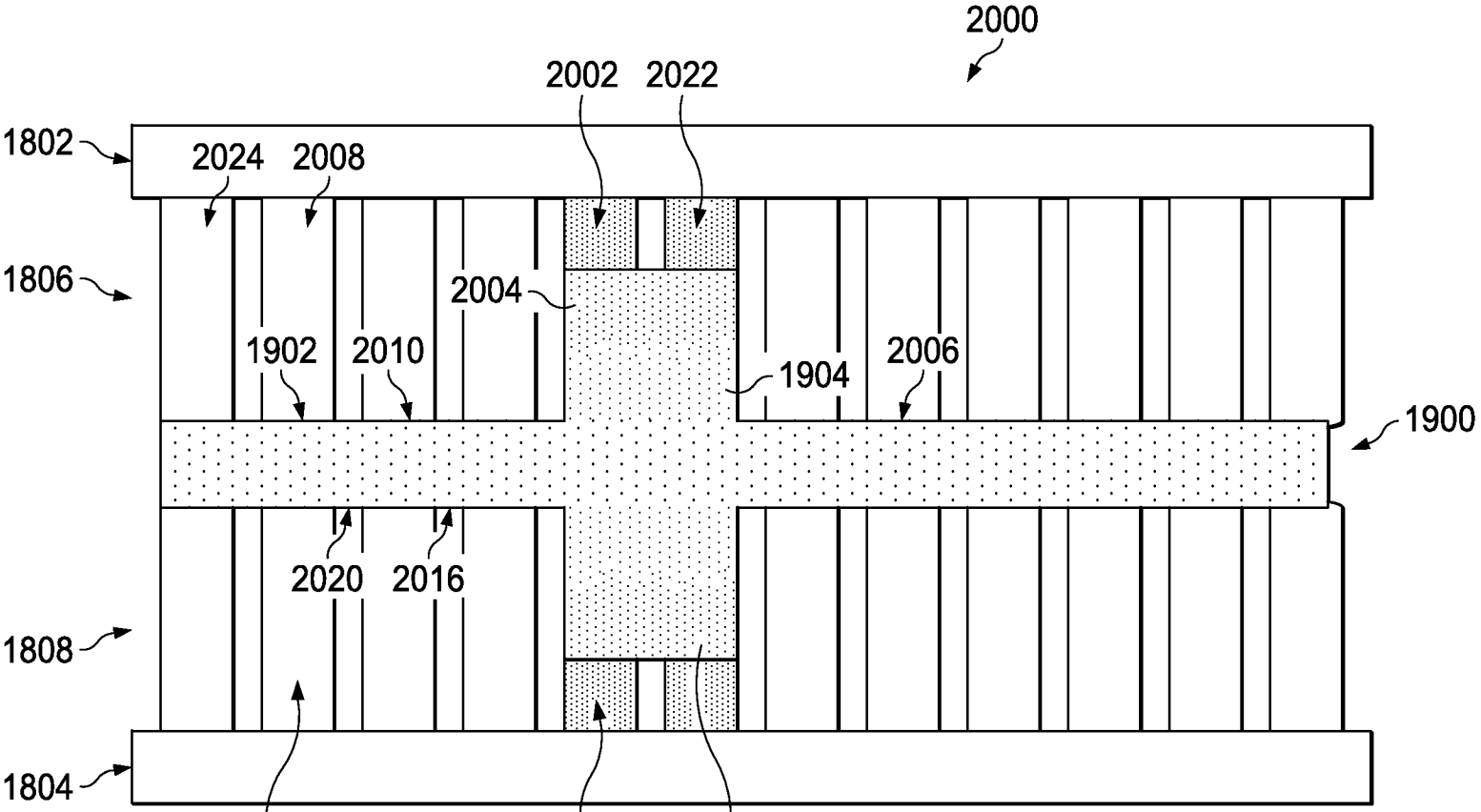
FIG. 20 is an illustration of a cross-sectional view of a workpiece positioned between a first platform and a second platform in accordance with an illustrative embodiment.

Turning now to FIG. 20, an illustration of a cross-sectional view of a workpiece positioned between a first platform and a second platform is depicted in accordance with an illustrative embodiment. View 2000 may be a view of workpiece 1900 in FIG. 9 positioned between first platform 1802 and second platform 1804 of FIG. 18.

As depicted in view 2000, number 2002 of plurality of elements 1806 contacts first portion 2004 of first surface 2006. Number 2008 of plurality of elements 1806 contacts second portion 2010 of first surface 2006. Number 2012 of plurality of elements 1808 contacts third portion 2014 of second surface 2016. Number 2018 of plurality of elements 1808 contacts fourth portion 2020 of second surface 2016.

Number 2002 of plurality of elements 1806 may apply first temperature 2022 to first portion 2004 of first surface 2006. Number 2012 of plurality of elements 1808 may apply first temperature 2022 to third portion 2014 of second surface 2016. Number 2008 of plurality of elements 1806 may apply second temperature 2024 to second portion 2010 of first surface 2006. Number 2018 of plurality of elements 1808 may apply second temperature 2024 to fourth portion 2020 of second surface 2016.

By applying first temperature 2022, number 2002 and number 2012 may cool second section 1904. By applying first temperature 2022, number 2002 and number 2012 may control the cooling rate of second section 1904. By controlling the cooling rate of second section 1904, desirable properties may be present in second section 1904 upon quenching.

While number 2002 and number 2012 cool second section 1904, number 2008 and number 2018 may maintain a temperature of first section 1902. In some illustrative examples, number 2008 and number 2018 may apply heat to first section 1902. By maintaining a high temperature in first section 1902, desirable properties may be present in first section 1902 upon quenching.

By reducing the temperature in second section 1904, desirable properties may be present in both first section 1902 and second section 1904 upon quenching. In some illustrative examples, the desirable properties may include a desirable shape of workpiece 1900. By controlling the cooling of second section 1904, substantially similar properties may be present in both first section 1902 and second section 1904 upon quenching.

Figure 21:
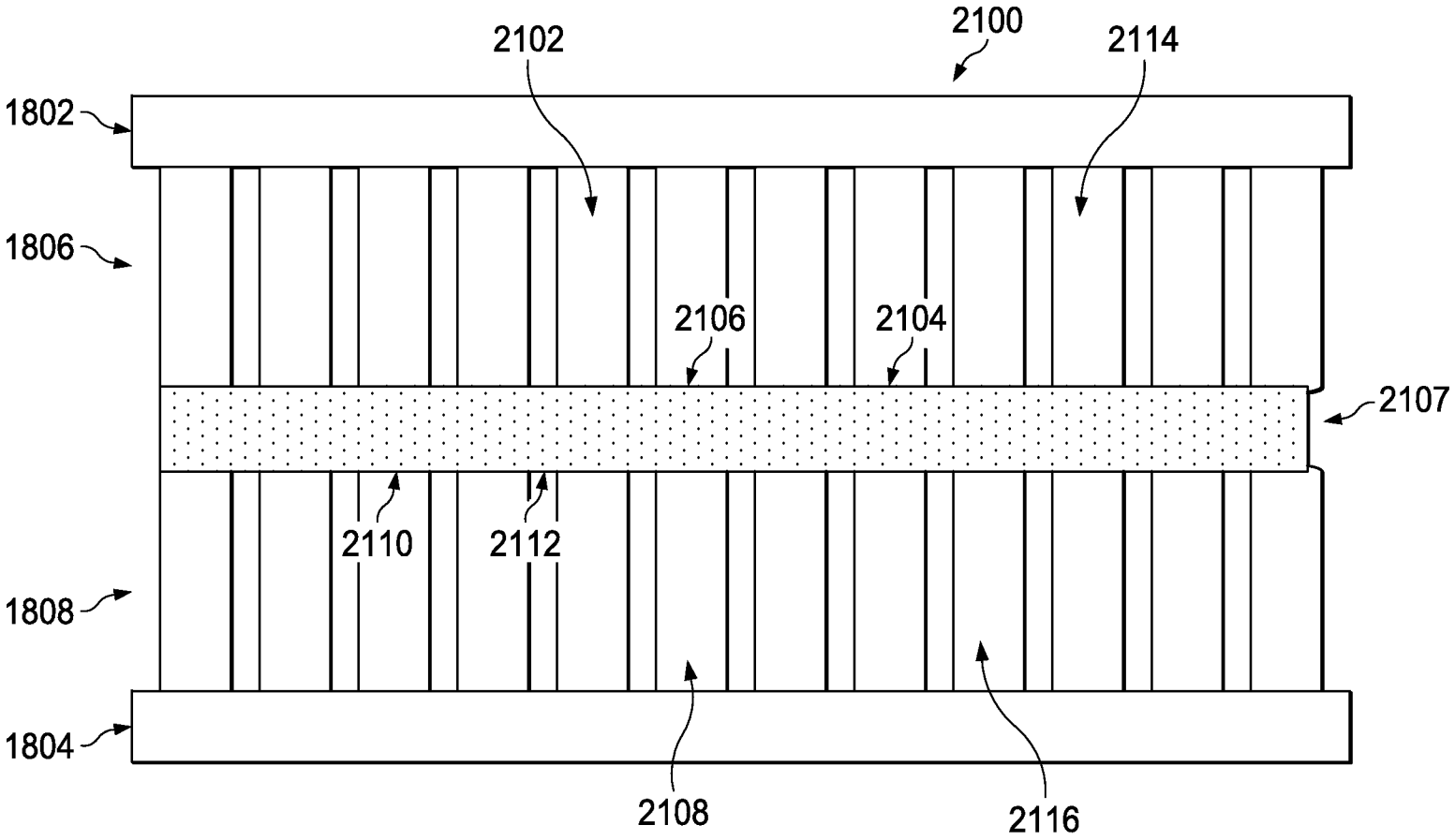
FIG. 21 is an illustration of a cross-sectional view of a workpiece positioned between a first platform and a second platform in accordance with an illustrative embodiment.

Turning now to FIG. 21, an illustration of a cross-sectional view of a workpiece positioned between a first platform and a second platform is depicted in accordance with an illustrative embodiment. View 2100 may be a view of a workpiece having a substantially uniform thickness positioned between first platform 1802 and second platform 1804 of FIG. 18.

As depicted in view 2100, number 2102 of plurality of elements 1806 contacts first portion 2104 of first surface 2106 of workpiece 2107. In this illustrative example, number 2102 may be all of plurality of elements 1806. In this illustrative example, first portion 2104 may be substantially all of first surface 2106.

Number 2108 of plurality of elements 1808 contacts second portion 2110 of second surface 2112. In this illustrative example, number 2108 may be all of plurality of elements 1808. In this illustrative example, second portion 2110 may be substantially all of second surface 2112.

Number 2102 of plurality of elements 1806 may apply first temperature 2114 to first portion 2104 of first surface 2106. Number 2108 of plurality of elements 1808 may apply second temperature 2116 to second portion 2110 of second surface 2112.

In some illustrative examples, first temperature 2114 and second temperature 2116 may be the same. In some illustrative examples, first temperature 2114 and second temperature 2116 may be different.

By applying first temperature 2114, number 2102 may cool first portion 2104. By applying first temperature 2114, number 2102 may control the cooling rate of first portion 2104. By applying second temperature 2116, number 2108 may control the temperature of second portion 2110. For example, by applying second temperature 2116, number 2108 may maintain temperature of second portion 2110. In some illustrative examples, number 2108 may apply heat to second portion 2110. In other illustrative examples, number 2108 may cool second portion 2110. By controlling the cooling rate of first portion 2104 and second portion 2110, desirable properties may be present in workpiece 2107 upon quenching. For example, by controlling the temperature of first portion 2104 and second portion 2110, a shape of workpiece 2107 after quenching may be desirable.

As depicted, workpiece 2107 may have a uniform thickness. When workpiece 2107 has a uniform thickness and first temperature 2114 and second temperature 2116 are the same, workpiece 2107 may be substantially planar upon quenching. When workpiece 2107 has a uniform thickness and first temperature 2114 and second temperature 2116 are different, a curvature or warpage may be induced in workpiece 2107. For example, when first temperature 2114 is lower than second temperature 2116, workpiece 2107 may curve inward towards second portion 2110. When first temperature 2114 is lower than second temperature 2116, workpiece 2107 may curve such that second portion 2110 is an inner surface of the curve.

Figure 22:
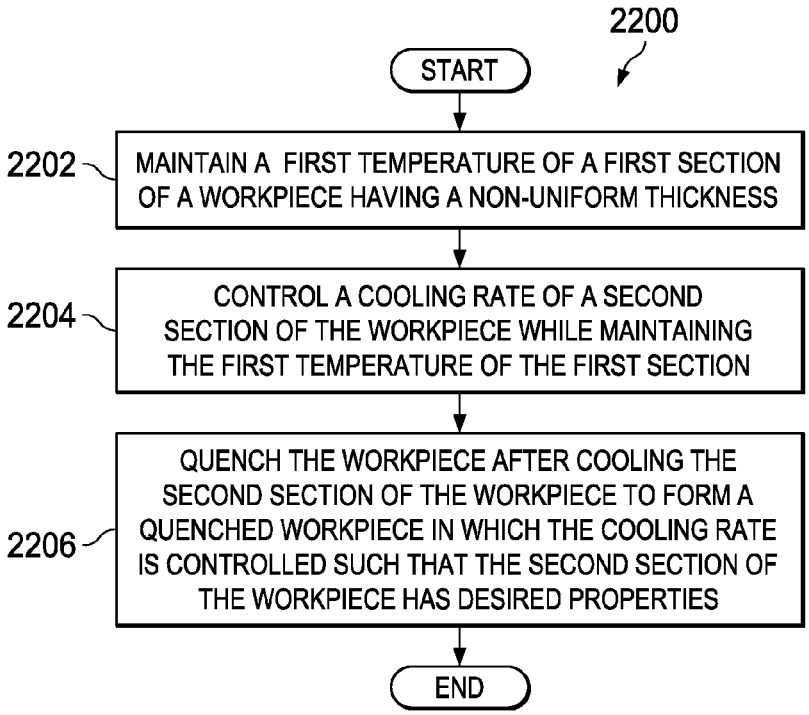
FIG. 22 is an illustration of a flowchart of a process for treating a workpiece in accordance with an illustrative embodiment.

Turning now to FIG. 22, an illustration of flowchart of a process for treating a workpiece is depicted in accordance with an illustrative embodiment. Process 2200 may be performed in manufacturing environment 1700 to form quenched workpiece 1790 having desired properties 1772. In some illustrative examples, process 2200 may be performed using first platform 1802 and second platform 1804 of FIG. 18.

Process 2200 may begin by maintaining a first temperature of a first section of a workpiece having a non-uniform thickness (operation 2202). In some illustrative examples, the first section of the workpiece may have a uniform thickness. In some illustrative examples, the first section may be thinner than the remainder of the workpiece.

A cooling rate of a second section of the workpiece may be controlled while maintaining the first temperature of the first section (operation 2204). In some illustrative examples, controlling the cooling rate of the second section of the workpiece may comprise cooling the second section of the workpiece to a pre-selected temperature using a number of tooling fingers. In some illustrative examples, the pre-selected temperature is selected such that the quenched workpiece has the desired properties, and wherein the desired properties are selected from at least one of microstructure, residual stress, or warpage.

The workpiece may be quenched after cooling the second section of the workpiece to form a quenched workpiece (operation 2206). The cooling rate may be controlled such that the second section of the workpiece has desired properties. Afterwards, the process terminates. In some illustrative examples, the second section of the workpiece has a greater thickness than the first section of the workpiece.

Figure 23:
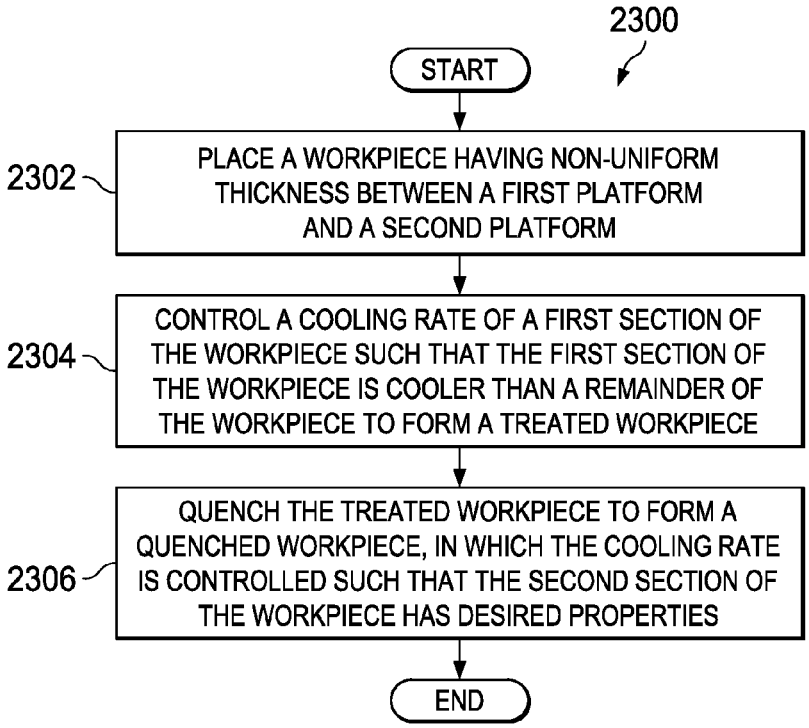
FIG. 23 is an illustration of a flowchart of a process for treating a workpiece in accordance with an illustrative embodiment.

Turning now to FIG. 23, an illustration of a flowchart of a process for treating a workpiece is depicted in the form of a flowchart in accordance with an illustrative embodiment. Process 2300 may be performed in manufacturing environment 1700 to form quenched workpiece 1790 having desired properties 1772. In some illustrative examples, process 2300 may be performed using first platform 1802 and second platform 1804 of FIG. 18.

Process 2300 may begin by placing a workpiece having non-uniform thickness between a first platform and a second platform (operation 2302). A cooling rate of a first section of the workpiece may be controlled such that the first section of the workpiece is cooler than a remainder of the workpiece to form a treated workpiece (operation 2304). In some illustrative examples, the workpiece may have non-uniform thickness. In some illustrative examples, the first section of the workpiece may be thicker than the remainder of the workpiece.

The treated workpiece may be quenched to form a quenched workpiece, in which the cooling rate is controlled such that the second section of the workpiece has desired properties (operation 2306). Afterwards, the process terminates.

The desired properties may comprise at least one of a desired microstructure, residual stress, or warpage. In some illustrative examples, a desired property may be no warpage. In some illustrative examples, a desired property may be a low residual stress. In other illustrative examples, a desired property may be no residual stress. In some illustrative examples, a desired property may be a substantially similar microstructure between the first section and the second section of the workpiece. In some illustrative examples, a desired property may be a desired shape.

Figure 24:
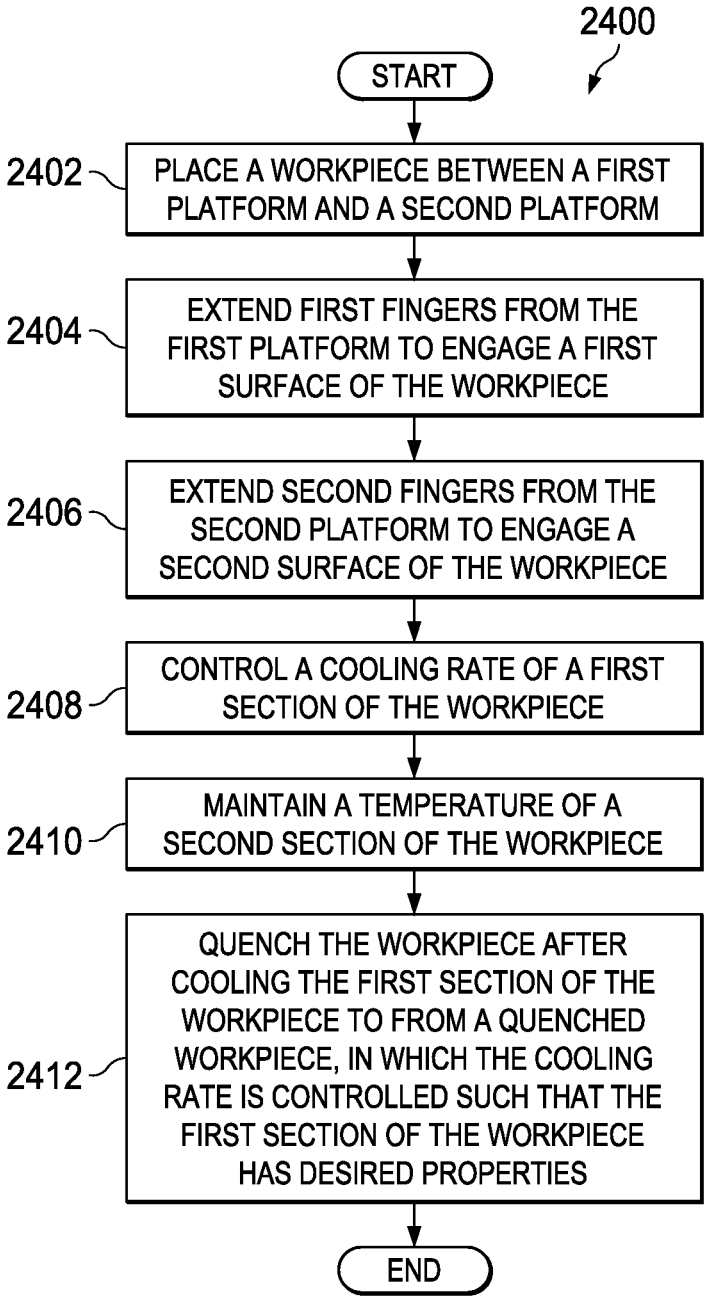
FIG. 24 is an illustration of a flowchart of a process for treating a workpiece in accordance with an illustrative embodiment.

Turning now to FIG. 24, an illustration of a flowchart of a process for treating a workpiece is depicted in accordance with an illustrative embodiment. Process 2400 may be performed in manufacturing environment 1700 to form quenched workpiece 1790 having desired properties 1772. In some illustrative examples, process 2400 may be performed using first platform 1802 and second platform 1804 of FIG. 18.

Process 2400 may begin by placing a workpiece between a first platform and a second platform (operation 2402). The workpiece may have a non-uniform thickness.

First fingers may be extended from the first platform to engage a first surface of the workpiece (operation 2404). Second fingers may be extended from the second platform to engage a second surface of the workpiece (operation 2406). A cooling rate of a first section of the workpiece may be controlled (operation 2408). Controlling the cooling rate may comprise applying a first temperature to a first portion of the first surface of the workpiece using a first number of the first fingers, and applying the first temperature to a third portion of the second surface of the workpiece using a third number of the second fingers.

A temperature of a second section of the workpiece may be maintained (operation 2410). Maintaining the temperature may comprise applying a second temperature to a second portion of the first surface of the workpiece using a second number of the first fingers, and applying the second temperature to a fourth portion of the second surface of the workpiece using a fourth number of the second fingers. The workpiece may be quenched after cooling the first section of the workpiece to form a quenched workpiece, in which the cooling rate is controlled such that the first section of the workpiece has desired properties (operation 2412). Afterwards, the process terminates.

Figure 25:
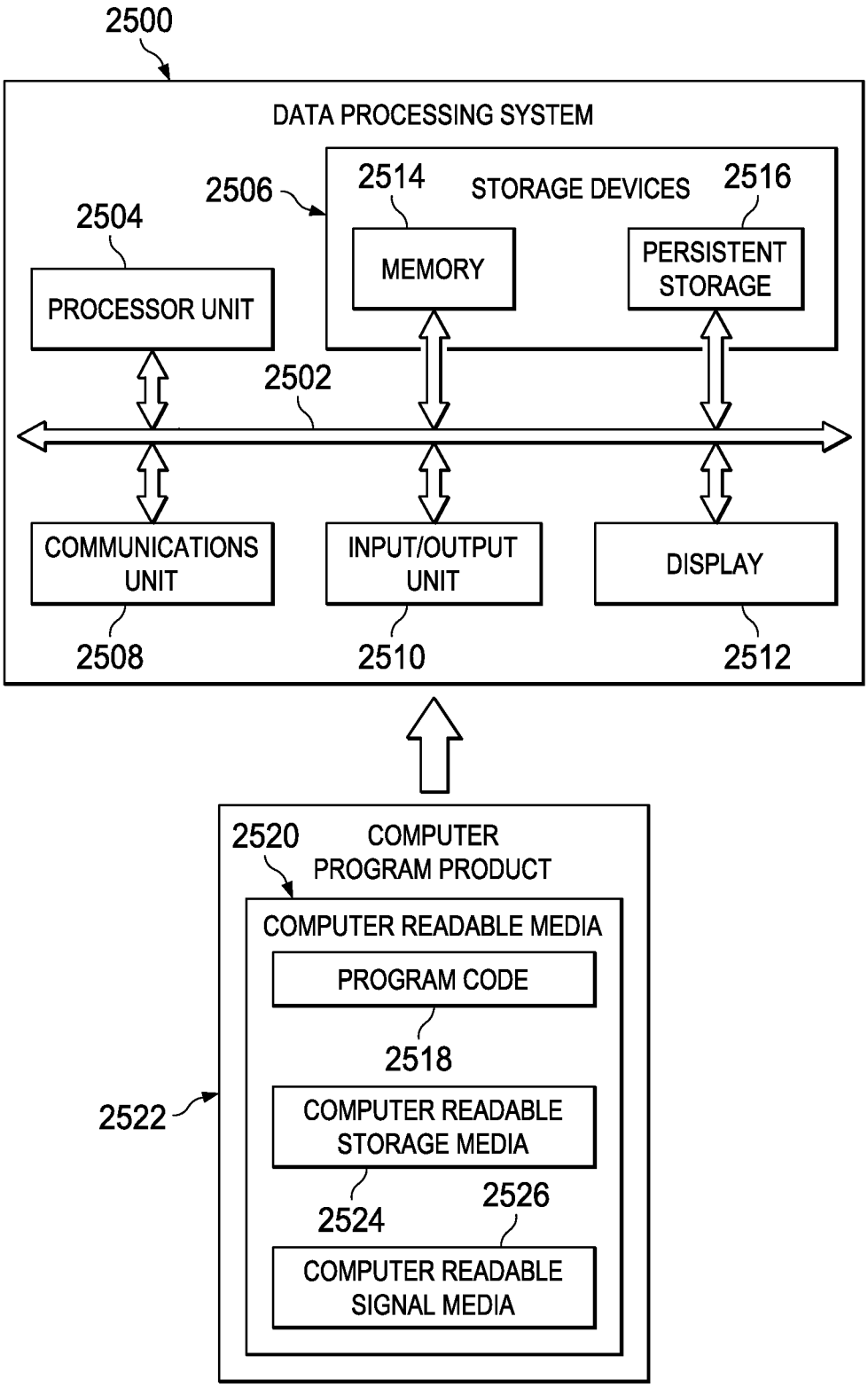
FIG. 25 is an illustration of a data processing system in the form of a block diagram in accordance with an illustrative embodiment.

Turning now to FIG. 25, an illustration of a data processing system is depicted in the form of a block diagram in accordance with an illustrative embodiment. Data processing system 2500 may be used to implement controller 1792 in FIG. 17. As depicted, data processing system 2500 includes communications framework 2502, which provides communications between processor unit 2504, storage devices 2506, communications unit 2508, input/output unit 2510, and display 2512. In some cases, communications framework 2502 may be implemented as a bus system.

Processor unit 2504 is configured to execute instructions for software to perform a number of operations. Processor unit 2504 may comprise a number of processors, a multiprocessor core, and/or some other type of processor, depending on the implementation. In some cases, processor unit 2504 may take the form of a hardware unit, such as a circuit system, an application specific integrated circuit (ASIC), a programmable logic device, or some other suitable type of hardware unit.

Instructions for the operating system, applications, and/or programs run by processor unit 2504 may be located in storage devices 2506. Storage devices 2506 may be in communication with processor unit 2504 through communications framework 2502. As used herein, a storage device, also referred to as a computer readable storage device, is any piece of hardware capable of storing information on a temporary and/or permanent basis. This information may include, but is not limited to, data, program code, and/or other information.

Memory 2514 and persistent storage 2516 are examples of storage devices 2506. Memory 2514 may take the form of, for example, a random access memory or some type of volatile or non-volatile storage device. Persistent storage 2516 may comprise any number of components or devices. For example, persistent storage 2516 may comprise a hard drive, a flash memory, a rewritable optical disk, a rewritable magnetic tape, or some combination of the above. The media used by persistent storage 2516 may or may not be removable.

Communications unit 2508 allows data processing system 2500 to communicate with other data processing systems and/or devices. Communications unit 2508 may provide communications using physical and/or wireless communications links.

Input/output unit 2510 allows input to be received from and output to be sent to other devices connected to data processing system 2500. For example, input/output unit 2510 may allow user input to be received through a keyboard, a mouse, and/or some other type of input device. As another example, input/output unit 2510 may allow output to be sent to a printer connected to data processing system 2500.

Display 2512 is configured to display information to a user. Display 2512 may comprise, for example, without limitation, a monitor, a touch screen, a laser display, a holographic display, a virtual display device, and/or some other type of display device.

In this illustrative example, the processes of the different illustrative embodiments may be performed by processor unit 2504 using computer-implemented instructions. These instructions may be referred to as program code, computer usable program code, or computer readable program code and may be read and executed by one or more processors in processor unit 2504.

In these examples, program code 2518 is located in a functional form on computer readable media 2520, which is selectively removable, and may be loaded onto or transferred to data processing system 2500 for execution by processor unit 2504. Program code 2518 and computer readable media 2520 together form computer program product 2523. In this illustrative example, computer readable media 2520 may be computer readable storage media 2525 or computer readable signal media 2526.

Computer readable storage media 2525 is a physical or tangible storage device used to store program code 2518 rather than a medium that propagates or transmits program code 2518. Computer readable storage media 2525 may be, for example, without limitation, an optical or magnetic disk or a persistent storage device that is connected to data processing system 2500.

Alternatively, program code 2518 may be transferred to data processing system 2500 using computer readable signal media 2526. Computer readable signal media 2526 may be, for example, a propagated data signal containing program code 2518. This data signal may be an electromagnetic signal, an optical signal, and/or some other type of signal that can be transmitted over physical and/or wireless communications links.

The flowcharts and block diagrams in the different depicted embodiments illustrate the architecture, functionality, and operation of some possible implementations of apparatus and methods in an illustrative embodiment. In this regard, each block in the flowcharts or block diagrams may represent a module, segment, function, and/or a portion of an operation or step. For example, one or more of the blocks may be implemented as program code, in hardware, or a combination of the program code and hardware. When implemented in hardware, the hardware may, for example, take the form of integrated circuits that are manufactured or configured to perform one or more operations in the flowcharts or block diagrams.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, process 2200 may further comprise cooling the second number of tooling fingers to a second temperature. As another illustrative example, process 2200 may further comprise moving the first number of tooling fingers to engage the first section of the workpiece, and moving the second number of tooling fingers to engage the second section of the workpiece.

In some illustrative examples, moving the first number of tooling fingers to engage the first section of the workpiece may comprise moving the first number of tooling fingers to engage a first surface and a second surface of the workpiece. In some illustrative examples, moving the second number of tooling fingers to engage the second section of the workpiece may comprise moving the second number of tooling fingers to engage the first surface and the second surface of the workpiece.

In some illustrative examples, process 2300 may further include heating the remainder of the workpiece using a number of fingers extending from the first platform and the second platform. In some illustrative examples, controlling the cooling rate of the first section of the workpiece comprises cooling the first section of the workpiece to a pre-selected temperature, and wherein the pre-selected temperature is selected such that the quenched workpiece has the desired properties, wherein the desired properties are selected from at least one of microstructure, residual stress, or warpage.

In some illustrative examples, process 2300 may further comprise cooling the first number of the first fingers and the third number of the second fingers. In some examples, process 2300 may further comprise heating the second number of the first fingers and the fourth number of the second fingers.

In this illustrative example, a method and apparatus for processing a workpiece are presented. A workpiece may receive processing between heating and quenching. The workpiece may have a non-uniform thickness that may result in at least one of undesirable microstructure, undesirable residual stresses, or warpage without processing.

Processing may include controlled cooling of a section of the workpiece. The controlled cooling may occur in a thick portion of the workpiece. A thin portion of the workpiece may not be cooled. In some illustrative examples, a thin portion of the workpiece may be heated or have its temperature maintained.

The thick portion of the workpiece may be cooled until a selected temperature is reached. Afterwards, the workpiece may be quenched. The workpiece may be quenched using a liquid or a gas. For example, the workpiece may be dropped into a container of liquid. In another example, the workpiece may be placed in a flow of air.

After quenching, the workpiece may have desirable properties as a result of having received processing. For example, the workpiece may not be warped. As another example, the workpiece may have substantially similar microstructures in both the thin and thick portions.

Processing the workpiece according to the illustrative examples may lower the cost of the workpiece. For example, without processing, a thicker portion of the workpiece may have an undesirable microstructure. In order to meet ratings for the workpiece, engineers must use the lower mechanical properties, such as undesirable microstructure, in the thick areas. This results in the thin regions becoming thicker, resulting in heavier and more expensive parts.

By controlled cooling of the thicker portion of the workpiece, at least one of manufacturing costs, material costs, or weight costs may be reduced. Further, by controlled cooling of the thicker portion of the workpiece, the shape of the quenched workpiece may be controlled. Yet further, by controlled cooling of the thicker portion of the workpiece, residual stresses within the workpiece may be controlled and tailored.

The description of the different illustrative embodiments has been presented for purposes of illustration and description and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method comprising:

maintaining a first temperature of a first section of a workpiece positioned on a tool while controlling a cooling rate of a second section of the workpiece to a pre-selected temperature, wherein the workpiece has a non-uniform thickness, and wherein controlling the cooling rate of the second section of the workpiece comprises cooling the second section of the workpiece to the pre-selected temperature using a number of tooling fingers of the tool;

removing the workpiece from the tool; and after removing the workpiece, quenching the workpiece using one or more of a fan system or a quench tank after cooling the second section of the workpiece to form a quenched workpiece, in which the cooling rate is controlled such that a second section of the quenched workpiece has desired properties.

2. The method of claim 1, wherein the pre-selected temperature is selected such that the quenched workpiece has the desired properties, and wherein the desired properties are selected from at least one of microstructure, residual stress, or warpage.

3. The method of claim 1, wherein the second section of the workpiece has a greater thickness than the first section of the workpiece.

4. The method of claim 1, wherein the pre-selected temperature is a first temperature, and the method further comprising:

cooling the number of tooling fingers to a second temperature.

5. The method of claim 1 further comprising:

moving a first number of tooling fingers to engage the first section of the workpiece; and moving a second number of tooling fingers to engage the second section of the workpiece.

6. The method of claim 5, wherein moving the first number of tooling fingers to engage the first section of the workpiece comprises moving the first number of tooling fingers to engage a first surface and a second surface of the workpiece.

7. The method of claim 6, wherein moving the second number of tooling fingers to engage the second section of the workpiece comprises moving the second number of tooling fingers to engage the first surface and the second surface of the workpiece.

8. A method comprising:

placing a workpiece having non-uniform thickness on a tool between a first platform and a second platform;

controlling a cooling rate of a first section of the workpiece such that the first section of the workpiece is cooler than a remainder of the workpiece to form a treated workpiece;

heating the remainder of the workpiece using a number of fingers extending from the first platform and the second platform;

removing the treated workpiece from the tool; and quenching the treated workpiece using one or more of a fan system or a quench tank to form a quenched workpiece, in which the cooling rate is controlled such that a second section of the quenched workpiece has desired properties.

9. The method of claim 8, wherein controlling the cooling rate of the first section of the workpiece comprises cooling the first section of the workpiece to a pre-selected temperature, and wherein the pre-selected temperature is selected such that the quenched workpiece has the desired properties, wherein the desired properties are selected from at least one of microstructure, residual stress, or warpage.

10. A method comprising:

placing a workpiece on a tool between a first platform and a second platform;

extending first fingers from the first platform to engage a first surface of the workpiece;

extending second fingers from the second platform to engage a second surface of the workpiece;

controlling a cooling rate of a first section of the workpiece, in which controlling the cooling rate comprises:

applying a first temperature to a first portion of the first surface of the workpiece using a first number of the first fingers; and applying the first temperature to a third portion of the second surface of the workpiece using a third number of the second fingers;

maintaining a temperature of a second section of the workpiece, in which maintaining the temperature comprises:

applying a second temperature to a second portion of the first surface of the workpiece using a second number of the first fingers;

applying the second temperature to a fourth portion of the second surface of the workpiece using a fourth number of the second fingers;

removing the workpiece from the tool; and quenching the workpiece using one or more of a fan system or a quench tank after cooling the first section of the workpiece to form a quenched workpiece, in which the cooling rate is controlled such that a first section of the quenched workpiece has desired properties.

11. The method of claim 10, wherein applying the first temperature to the first portion and applying the first temperature to the third portion cools the first section of the workpiece to a pre-selected temperature.

12. The method of claim 11, wherein the pre-selected temperature is selected such that the quenched workpiece has the desired properties, wherein the desired properties are selected from at least one of microstructure, residual stress, or warpage.

13. The method of claim 10 further comprising:

cooling the first number of the first fingers and the third number of the second fingers.

14. The method of claim 13 further comprising:

heating the second number of the first fingers and the fourth number of the second fingers.

15. A method comprising:

moving a first number of tooling fingers to engage a first section of a workpiece positioned on a tool, wherein the workpiece has a non-uniform thickness;

moving a second number of tooling fingers to engage a second section of the workpiece;

maintaining a first temperature of the first section while controlling a cooling rate of the second section to a pre-selected temperature;

removing the workpiece from the tool; and after removing the workpiece, quenching the workpiece using one or more of a fan system or a quench tank after cooling the second section of the workpiece to form a quenched workpiece, in which the cooling rate is controlled such that a second section of the quenched workpiece has desired properties.

16. The method of claim 15, wherein controlling the cooling rate of the second section of the workpiece comprises cooling the second section of the workpiece to the pre-selected temperature using a number of tooling fingers of the tool.

17. The method of claim 15, wherein the pre-selected temperature is selected such that the quenched workpiece has the desired properties, and wherein the desired properties are selected from at least one of microstructure, residual stress, or warpage.

18. The method of claim 15, wherein the second section of the workpiece has a greater thickness than the first section of the workpiece.

19. The method of claim 15, wherein the pre-selected temperature is a first temperature, and the method further comprising:

cooling the number of tooling fingers to a second temperature.

20. The method of claim 19, wherein moving the first number of tooling fingers to engage the first section of the workpiece comprises moving the first number of tooling fingers to engage a first surface and a second surface of the workpiece.

* * * * *